US008235231B2

(12) United States Patent
Schneider et al.

(10) Patent No.: US 8,235,231 B2
(45) Date of Patent: Aug. 7, 2012

(54) CRANE CONTROL WITH ACTIVE HEAVE COMPENSATION

(75) Inventors: Klaus Schneider, Hergatz (DE); Oliver Sawodny, Stuttgart (DE); Joerg Neupert, Korntal-Muenchingen (DE); Tobias Mahl, Stuttgart (DE); Sebastian Kuchler, Boblingen (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 357 days.

(21) Appl. No.: 12/454,619

(22) Filed: May 20, 2009

(65) Prior Publication Data

US 2010/0230370 A1 Sep. 16, 2010

(30) Foreign Application Priority Data

May 21, 2008 (DE) ..... 10 2008 024 513

(51) Int. Cl.
*B66C 23/52* (2006.01)

(52) U.S. Cl. ..... 212/308; 212/277

(58) Field of Classification Search ..... 212/307, 212/308, 276, 277

See application file for complete search history.

(56) References Cited

U.S. PATENT DOCUMENTS

| | | | | |
|---|---|---|---|---|
| 6,631,300 | B1 | 10/2003 | Nayfeh et al. | |
| 6,826,452 | B1 | 11/2004 | Holland et al. | |
| 7,367,464 | B1 | 5/2008 | Agostini | |
| 2008/0053945 | A1 * | 3/2008 | Schneider et al. | 212/276 |
| 2009/0008351 | A1 * | 1/2009 | Schneider et al. | 212/272 |

FOREIGN PATENT DOCUMENTS

| | | |
|---|---|---|
| DE | 60019794 | 3/2006 |
| EP | 1757554 | 2/2007 |
| JP | 01-285586 | 11/1989 |
| WO | 2005/090226 | 9/2005 |
| WO | 2006/052907 | 5/2006 |

OTHER PUBLICATIONS

Neupert, J. et al, "A Heave Compensation Approach for Offshore Cranes," American Control Conference, 2008, IEEE, Piscataway, New Jersey, USA, Jun. 11, 2008, pp. 538-543.

* cited by examiner

*Primary Examiner* — Emmanuel M Marcelo
(74) *Attorney, Agent, or Firm* — Dilworth & Barrese, LLP.

(57) ABSTRACT

The present invention represents a procedure for compensating the heave movement of offshore cranes. The dynamic model of the compensation actuator (hydraulically operated winch) and the load hanging on a rope are derived. Based on this model, a path-tracking control unit is developed. To compensate the movement of the ship/watercraft caused by waves, the heave movement is defined as a time-varying disturbance and is analyzed with respect to uncoupling conditions. With a model expansion, these conditions are satisfied, and an inversion-based uncoupling control law is formulated. To stabilize the system, an observer is used for reconstructing the unknown state by means of a force measurement. Furthermore, the compensation efficiency can be improved by predicting the heave movement. There is proposed a prediction method in which no ship/watercraft models or properties are required. The simulation and measurement results validate the heave compensation method.

20 Claims, 15 Drawing Sheets

CRANE CONTROL WITH ACTIVE HEAVE COMPENSATION

BACKGROUND OF THE INVENTION

The present invention relates to a crane control with active heave compensation for a crane arranged on a floating body, which includes a hoisting gear for lifting a load hanging on a rope.

Such crane controls are required to compensate the undesired influences of the sea waves on the movement of the load, which otherwise impair the safety and accuracy of the hoisting operation, in a crane mounted on a floating body, such as a ship, a semi-submersible platform or a bark.

For the installation of offshore wind parks and underwater extraction plants, an increasing demand of floating cranes exists, so that crane controls with heave compensation have a particular importance. Such crane control should provide for a safe, exact and efficient operation of the crane also under poor weather conditions with great heave, in order to minimize the weather-related downtimes. In addition, the safety of both operating personnel and equipment should be ensured.

If a crane is mounted on a floating body, a movement of the floating body due to heave leads to a movement of the load suspension point of the load hanging on the crane. On the one hand, this leads to a corresponding movement of the load, which impedes the exact positioning of the load and endangers the assembly personnel. For instance, if a rotor should be mounted on an offshore wind turbine, an extremely accurate positioning of the rotor blades on the hub is required, where the same must be screwed by the mechanics. Here, every uncontrolled movement of the rotor blade due to heave can have devastating consequences. In addition, the movement of the load suspension point can lead to critical force peaks in the rope and in the crane, which must be considered in particular in the case of deep-sea hoisting operations.

In cranes in accordance with the prior art it has already been attempted to at least partly compensate the movement of the load during sea movements. On the one hand, passive systems are known, in which the heave movement should be compensated passively by the construction of crane and hoisting gear. There are also known active controls, in which the movement of the load suspension point generated by the heave movement should be compensated by active countersteering. However, none of the known systems has led to a really satisfactory solution.

SUMMARY OF THE INVENTION

Therefore, it is the object of the present invention to provide an improved crane control with active heave compensation.

This object is solved by a crane control according to the description herein. The present invention thus provides a crane control with active heave compensation for a crane arranged on a floating body, which includes a hoisting gear for lifting a load hanging on a rope. The crane control includes a measuring device which determines a current heave movement from sensor data. Furthermore, a prediction device is provided, which predicts a future movement of the load suspension point based on the determined current heave movement and a model of the heave movement. Furthermore, a path control of the load is provided, which by actuating the hoisting gear of the crane due to the predicted movement of the load suspension point at least partly compensates the movement of the load caused by the heave.

By means of the prediction device of the invention it hence is possible to consider the future movement of the load suspension point, when actuating the hoisting gear, based on the determined current heave movement and a model of the heave movement, so that this movement of the load suspension point is compensated by a change in the rope length, and the load follows the intended path. As compared to a path control which is merely based on the current movement of the load suspension point, the path control based on the future movement predicted by the prediction device leads to a considerably improved heave compensation. The reason in particular consists in that in particular with great loads, the actuators of a crane have high dead times and considerable time constants of up to 0.5 seconds. Actuation merely on the basis of the currently measured movement of the load suspension point hence would lead to a delayed reaction. In accordance with the invention, the prediction device therefore has a prediction horizon of more than 0.5 seconds, advantageously more than 1 second and furthermore advantageously more than 2 seconds, so that despite the dead times and time constants of the hoisting gear a safe compensation of the movement of the load suspension point due to the heave movement of the floating body can be performed. Advantageously, the control considers the predicted movement of the load suspension point and the dead times of the hoisting gear during actuation thereof.

Beside the predicted movement of the load suspension point, the desired path of the load is of course also included in the path control of the load, which is generated by a path planning unit e.g. on the basis of control commands of an operator or on the basis of an automatically provided course of hoisting. In accordance with the invention, the path control now ensures that the path of the load provided by the path planning unit is maintained despite the movement of the load suspension point, which is caused by the heave movement of the floating body. By means of the crane control of the invention, an exact positioning of the load can thus be ensured. Furthermore, it is ensured that there are no overloads of the rope or the crane during the hoisting operation.

Advantageously, the model of the heave movement as used in the prediction device is independent of the properties, in particular of the configuration and dynamics of the floating body. In this way, the crane control of the invention can flexibly be used for a multitude of floating bodys. In particular, the crane hence can be mounted on different ships, without each time having to adapt the heave compensation of the crane control, which would be very expensive in a modeling depending on the properties of the ship. Independent of the properties of the floating body, the model hence is created on the basis of the measured heave movement alone, for which purpose the periodic portions of the heave movement are used. For this purpose, not only the current heave movement, but also the course of the heave movement is analyzed continuously for a certain period.

Advantageously, the prevailing modes of the heave movement are determined from the data of the measuring device, in particular by means of a frequency analysis, and with reference to the prevailing modes thus determined a heave model is determined. Thus, the prediction device analyzes the heave movement and determines the frequencies which determine the movement of the floating body due to the heave. For instance, a Fourier analysis of the heave movement can be performed here, from which the prevailing modes are determined by peak detection. Advantageously, at least the three strongest modes of the heave movement are considered, furthermore advantageously up to ten modes. The modes are determined by means of a long-term observation of the heave movement, wherein the analysis can extend to a period of the preceding heave movement of several minutes, e.g. to the preceding five minutes. On the basis of the prevailing modes, the prediction device hence creates a preliminary model of the heave, which is based on a long-term observation of the heave movement.

Advantageously, the model thus created is parametrized continuously with reference to the data of the measuring device, in particular via an observer, wherein in particular amplitude and phase of the modes are parametrized. Beside the creation of a preliminary model due to long-term determination of the prevailing modes, this model hence is continuously adapted to the current data of the measuring device. Matching between the heave predicted by the model and the heave measured is constantly effected, wherein the prediction device continuously updates the amplitudes and phases of the individual modes used in the model. Weighting of the individual modes likewise can be updated continuously in the model.

In accordance with the invention, a two-part prediction thus is obtained, in which the prevailing modes of the heave movement initially are determined by means of a long-term analysis, which modes form the basis for the model of the heave movement. Via an observer circuit, this model then is constantly updated, in that the amplitude and phase of the modes are re-parametrized by a comparison of the heave movement predicted by the model and the measured heave movement. The prevailing modes are, however, not changed by the observer.

Advantageously, however, the model each is updated in the case of a change in the prevailing modes of the heave. This change in the prevailing modes of the heave is detected by a long-term observation of the heave movement, wherein the model is updated when the deviation of the modes used in the model from the actually prevailing modes has exceeded a certain threshold. For instance, updating the prevailing modes in the model of the heave can be provided every 20 seconds.

Furthermore advantageously, the path control of the invention includes a pilot control which is stabilized on the basis of sensor data. The path control hence actuates the hoisting gear on the basis of the predicted movement of the load suspension point such that a planned path of the load is maintained as accurately as possible. For stabilizing the pilot control, sensor data are used, so that by means of an observer circuit a more precise actuation of the hoisting gear becomes possible.

Advantageously, the path control is based on a model of crane, rope and load, in which a change of the rope length due to the elongation of the rope is considered. Since in particular in deep-sea hoisting operations rope lengths of up to 4000 m can occur, a great elongation of the rope can occur, which now is considered in the path control in accordance with the invention.

Furthermore advantageously, the path control is based on a model of crane, rope and load, which considers the dynamics of the hoisting gear and/or of the rope and in particular is based on a physical model of the dynamics of the system of hoisting gear, rope and/or load. Advantageously, the dynamics of the hoisting gear is considered, so that the pilot control also considers e.g. reaction times and inertias of the hoisting gear. To consider the dynamics of the system of rope and load, the same advantageously is treated as a damped oscillator. The dynamics resulting therefrom is modelled in the system and is included in the pilot control of the path control of the invention, whereby the dynamic change in length of the rope can be considered in the pilot control.

Advantageously, a force sensor for measuring the force acting in the rope and/or on the hoisting gear is provided in accordance with the invention, whose measurement data are included in the path control and by means of which in particular the rope length is determined. A direct feedback of the position of the load to the path control for stabilization is not possible, since the position of the load itself is difficult to measure. In accordance with the invention, the force therefore is measured in the rope or on the hoisting gear and used for stabilizing the actuation. The rope length can be reconstructed from the force in the rope on the basis of the model for the dynamics of the system of rope and load, and in this way the position of the load can be determined.

Furthermore advantageously, the measuring device of the present invention comprises gyroscopes, acceleration sensors and/or GPS elements, from whose measurement data the current heave movement is determined. Beside measuring devices which employ only one of these three types of sensor, there can also be used systems with a combination of two or three of these types of sensor. In particular, gyroscopes are used in accordance with the invention. An absolute determination of the position is possible with such gyroscopes, but not necessary either for the active heave compensation, since here merely the relatively high-frequency movements of the floating body as a result of the heave movement must be considered, whereas a slow drift makes no great difference. From the data of the gyroscopes, the angular velocities or the position of the measurement point, at which the gyroscopes are arranged, then are determined by single or double integration.

Advantageously, the sensors of the measuring device are arranged on the crane, in particular on the crane base, wherein the measuring device advantageously determines the movement of the load suspension point with reference to a model of the crane and the relative movement of load suspension point and measurement point. If the sensors are arranged on the foundation of the crane, the same firmly move with the floating body and thus merely measure the heave movement of the floating body. With reference to the model of the crane, the movement of the load suspension point can be determined from this heave movement of the floating body.

Advantageously, the heave movement of the floating body is used in the prediction device for predicting the future movement of the floating body, and with reference to the model of the crane the future movement of the load suspension point due to this future movement of the floating body is determined therefrom. By arranging the sensors of the measuring device on the crane, it is ensured that the crane control of the invention can be used flexibly and independent of the properties of the floating body.

By way of example, the prediction device merely determines the future movement of the load suspension point in the vertical. Due to this restriction to one degree of freedom, a particularly simple prediction device is provided, which with comparatively little constructive effort nevertheless supplies the decisive data for compensation of the heave movement.

The present invention furthermore comprises a crane with a crane control as described above. In particular, the crane is a ship crane. Beside a hoisting gear, the crane of the invention advantageously comprises a slewing gear and a luffing gear, which likewise are actuated by the crane control of the invention.

Furthermore, the present invention also comprises a floating body with a crane as described in accordance with the invention. In particular, the floating body advantageously is a ship with a ship crane.

The present invention furthermore comprises a method for controlling a crane arranged on a floating body, which includes a hoisting gear for lifting a load hanging on a rope, with the following steps: determining the current heave movement from sensor data, predicting a future movement of the load suspension point based on the determined current heave movement and a model of the heave movement, and at least partly compensating the movement of the load due to the heave by actuating the hoisting gear of the crane on the basis of the predicted movement of the load suspension point. Quite obviously, the same advantages are obtained by the method of the invention as described already with respect to the crane control.

Furthermore advantageously, the procedure in the method for controlling the crane is as described already with respect to the crane control. In particular, the method of the invention is performed by means of a crane control as described above.

BRIEF DESCRIPTION OF THE DRAWINGS

The present invention will now be described in detail with reference to an embodiment and the drawings, in which.

DESCRIPTION OF THE PREFERRED EMBODIMENTS

Figure 1:
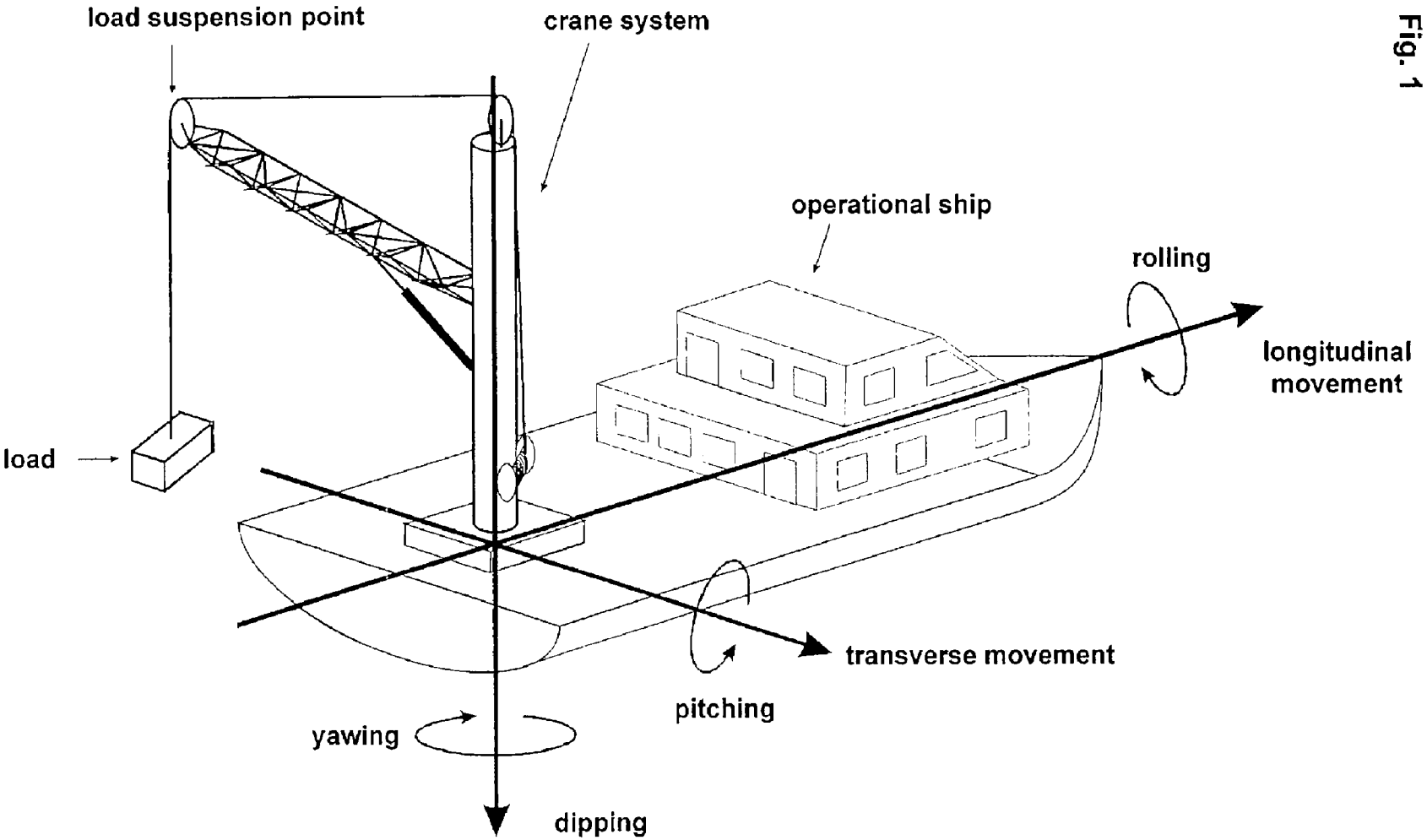
FIG. 1 shows an embodiment of a ship crane, in which the present invention is used.

Now, there is first described an embodiment of a measurement method which on the one hand is based on the measurement of the movement of the ship and on the other hand on the determination of the relative position of the boom tip of the crane system proceeding from its foundation. For the first-mentioned measurement task, an inertial platform is used, which measures the linear accelerations and rotatory rates of rotation about all three axes of the ship. The latter must be performed by the sensors of the crane system. With this measurement arrangement, a measurement of the dip movement free from drift, an extremely small phase shift in the significant frequency range of the dip movement, and a maximum measurement deviation of about 15% of the amplitude of the dip movement is achieved. The embodiment of a method for predicting the dip movement of the load suspension point is based on a model of this movement. Since the model can, however, not be created a priori, the same must be identified and parametrized online with reference to the measured dip movement. The identification is achieved by means of a frequency analysis of the vertical movement of the load suspension point. To always correctly describe the dip movement with the model thereof, identification is effected in regular intervals. For an optimum parametrization of the modeled dip movement, an observer is used. The predicted heave movement then is used to minimize the influence of the heave on the movement of the load by countersteering with the hoisting gear.

Deploying and recovering unmanned research stations, which track down resources and supply scientific insights of oceanography, in a depth of several thousand meters is not possible without determination of the heave movement of the operational ship. Every year, numerous constructions such as oil or gas drilling rigs or also wind parks with several dozens of wind turbines are erected to satisfy the enormous energy an optimum parametrization of the modeled dip movement, an observer is used. The predicted heave movement then is used to minimize the influence of the heave on the movement of the load by countersteering with the hoisting gear.

Deploying and recovering unmanned research stations, which track down resources and supply scientific insights of oceanography, in a depth of several thousand meters is not possible without determination of the heave movement of the operational ship. Every year, numerous constructions such as oil or gas drilling rigs or also wind parks with several dozens of wind turbines are erected to satisfy the enormous energy demand of mankind. Erecting these plants is performed by means of floating cranes, which are exposed to the sea waves of the respective region. To avoid collisions of the load with the seabed or with the already existing shell, the change in height of the load caused by the ship movement must be compensated by heave compensation means. Here, the knowledge of the vertical ship movement again is of central importance.

For these examples, the measurement of the heave movement of the ship is sufficient. This is understood to be the vertical deflection of the ship about its rest position. The rest position of a ship is defined to be the current mean height of the smooth sea level. Slow changes in level, which are located below a firmly defined frequency limit, thus are not part of the heave movement. The same include for instance the changes in level caused by the tides, which clearly cannot be assigned to the heave movement.

For this purpose, the present invention provides a measurement method which can be used in conjunction with any crane system with active heave compensation (AHC). The measurement method on the one hand determines the heave movement of the load suspension point and on the other hand calculates a short-term prediction for the further course of this movement. As an entire system, the combination between crane and firmly installed measurement system, which is referred to as active heave compensation means, can be mounted on a multitude of ships without considerable measures of adaptation being required. Depending on the construction of the crane, this heave compensation means can either be used as a floating crane or, mounted on an operational craft, also for deep-sea hoisting. For this purpose, the measurement method is completely autonomous and acts in a platform-independent way. The knowledge of ship-specific data such as displacement, shape of hull etc. or also the placement of the crane system on the deck of the ship is omitted deliberately. Therefore, the term ship also should be understood in a rather broad sense. It is synonymous with any kind of floating body and hence also comprises barges or semi-submersible platforms.

Heave compensation means is understood to be a technical system, which is capable of reducing the vertical load oscillations induced by the sea waves. In the ideal case, the load should be kept at an equidistant distance from the seabed, independent of whether the floating crane is located on a wave crest or in a wave trough. In addition, tilting of the floating crane about the longitudinal and transverse axes, which is referred to as rolling and pitching movement, should not influence the height of the load. If the compensation of the undesired load oscillation is effected purely constructively, a passive heave compensation exists. On the other hand, reference is made to an active heave compensation, as soon as the load oscillation is deliberately counteracted by means of actuators.

The present measurement method is capable of determining the heave movement of the load suspension point with a high resolution and without time delay. This is also achieved in offshore use, where wave heights of up to 10 m must be expected. Slow absolute changes in position of the rest position of the ship are not of interest here.

The objective of the prediction of the heave movement of the load suspension point is to minimize the negative influence of the dead times of the actuators of heave compensation means on the load height. For generating the desired trajectory of the load movement, a course of the position of the load suspension point thus can be specified, which lies in the future by the dead time of the corresponding actuator, so that a constant dead time is at best completely compensated. Since in deep-sea hoisting, the load masses lie in the range of up to 100 t and in the case of semi-submersible crane platforms can even be up to about 14,000 t, dead times of about 0.2-0.5 s are quite normal. The same result from the enormous energy which must be provided for the load movement. For fulfilling the required task, a time window of about 1 s thus is sufficient for prediction.

FIG. 1 shows a crane ship which chiefly is used for installation tasks above sea level. It can clearly be seen that floating cranes generally have a load suspension point which is located far above the sea level. Its position can be specified by the crane operator by means of control levers, so that the load can accurately be positioned. In deep-sea hoisting, rigid crane constructions mostly are used, which have a rather low load suspension point. The same have the advantage that they do not unnecessarily amplify the movements of the ship. Horizontal changes in position of the load are achieved either by actuators on the load hook or by correspondingly positioning the operational ship.

With respect to heave compensation, the actual structure of the crane system is important. It should be possible to merely measure the vertical position of the load suspension point. However, since mounting the sensors directly on the load suspension point generally cannot be realized, an alternative mounting point of the sensors must be chosen. Attachment close to the crane base is found to be expedient. On the one hand, the smallest vibrations of the crane system must be expected here, which distort the measurement results. On the other hand, a firmly defined orientation of the sensors during operation is achieved here. This would, for instance, not be possible when positioning the sensors on a movable part of the crane.

For this invention, an inertial platform (IMU—Initial Measurement Unit) therefore is used for measuring the ship movement, which is attached to the crane foundation. This inexpensive and autonomous measurement unit contains three acceleration sensors for measuring the linear ship movements, as well as three rotational rate sensors for determining the rolling, pitching and yawing movement of the ship. The sampling frequency of the measurements is about 40 Hz. The relevant ship movements, however, lie in a frequency range between 0.04 Hz and 1 Hz. Furthermore, even in rough seas, the measurement values in the entire range of operation of the ship cranes do not fall within the range of restriction of measurement values. Thus, an accurate determination of the ship movement is possible in all 6 degrees of freedom by means of the chosen inertial platform.

The method for measuring the ship movement, which is used for the present invention, is based on the measurement signals of a single inertial platform which calculates the desired position and angle signals by means of integrating filters of constant limit frequency. If a more precise measurement is desired in a heave compensation, the clear separation between measurement and prediction also provides for replacing the measurement method at any time, without further adaptations being necessary.

Figure 2:
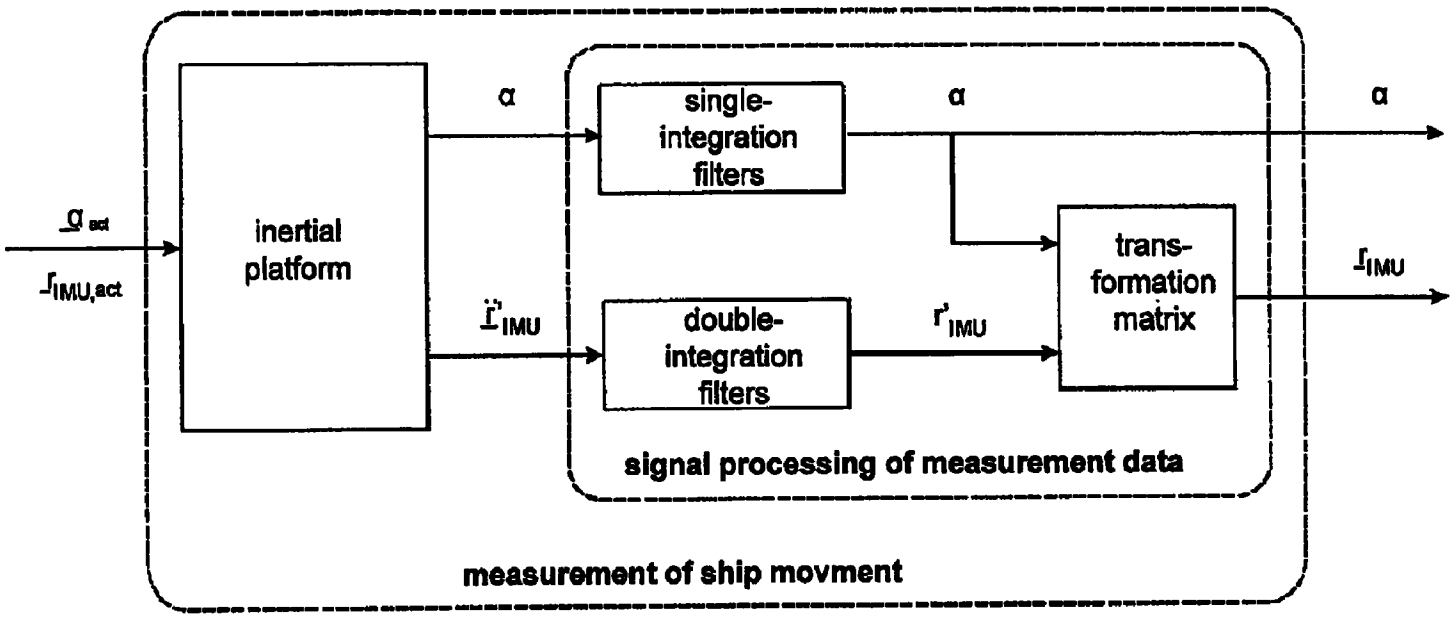
FIG. 2 shows a schematic diagram of a measurement method for determining a heave movement of a ship.

To obtain the tilt of the ship from the rotational rates measured by the gyroscopes of the inertial platform, a single integration is necessary. In addition, the typical measurement errors such as measurement noise or bias errors must be compensated. This is accomplished by using one single-integration filter each per direction of rotation. To obtain the position of the inertial platform, the acceleration data must be subjected to a double integration. The measurement errors occurring here also must be eliminated as far as possible, so that for each of the three linear directions of movement a double-integration filter must be used. This is schematically shown in FIG. 2.

By using the signal processing described above for measuring the ship movement, the complete movement of the ship can be determined from the measurement signals of the inertial platform. Static bias errors are completely eliminated, and a slow drift in the measurement signals is largely compensated. Due to the necessary integration of the measured values, high-frequency sensor noise also is greatly suppressed, so that no additional low-pass filtering is necessary.

Figure 3:
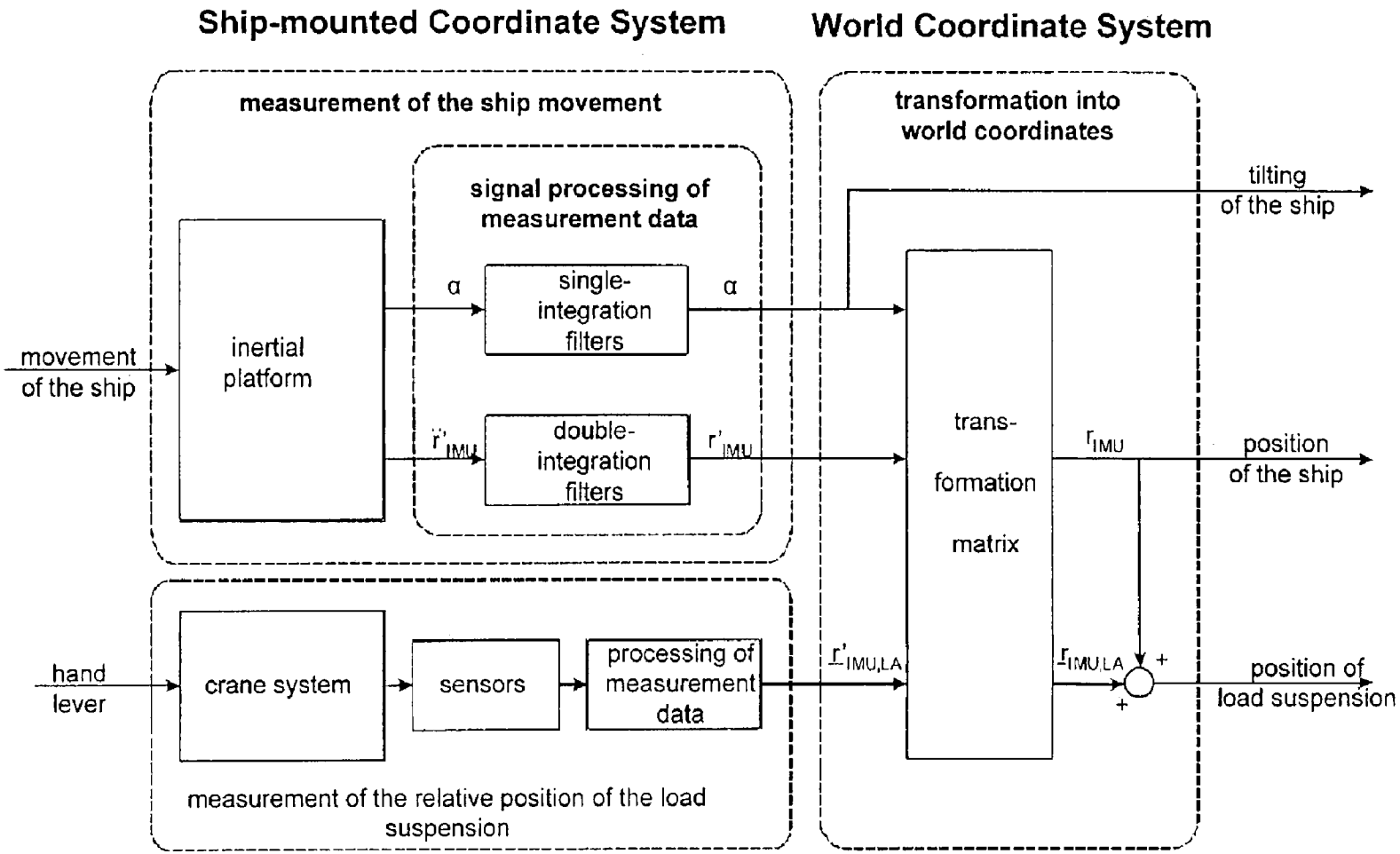
FIG. 3 shows a schematic diagram of a method with which the heave movement of the load suspension point is determined from the heave movement of the ship and a relative movement between load suspension point and measurement point.

Since the distance between the sensor for measuring the ship movement and the load suspension also is necessary for measuring the heave movement of the load suspension point, the same is determined separately. The sensors necessary for this purpose are known, however, from conventional crane controls. From the measurement of the ship movement and the knowledge of the distance between the sensor for measuring the ship movement and the load suspension, the current movement of the load suspension point hence can be determined, as shown in FIG. 3.

The model used for prediction of the heave movement does not represent a description of the dynamics of the ship known a priori. The model rather illustrates the dynamics of the measured heave movement. The same is determined during the runtime of the heave compensation, so that the model constantly is newly identified and parametrized.

Figure 4:
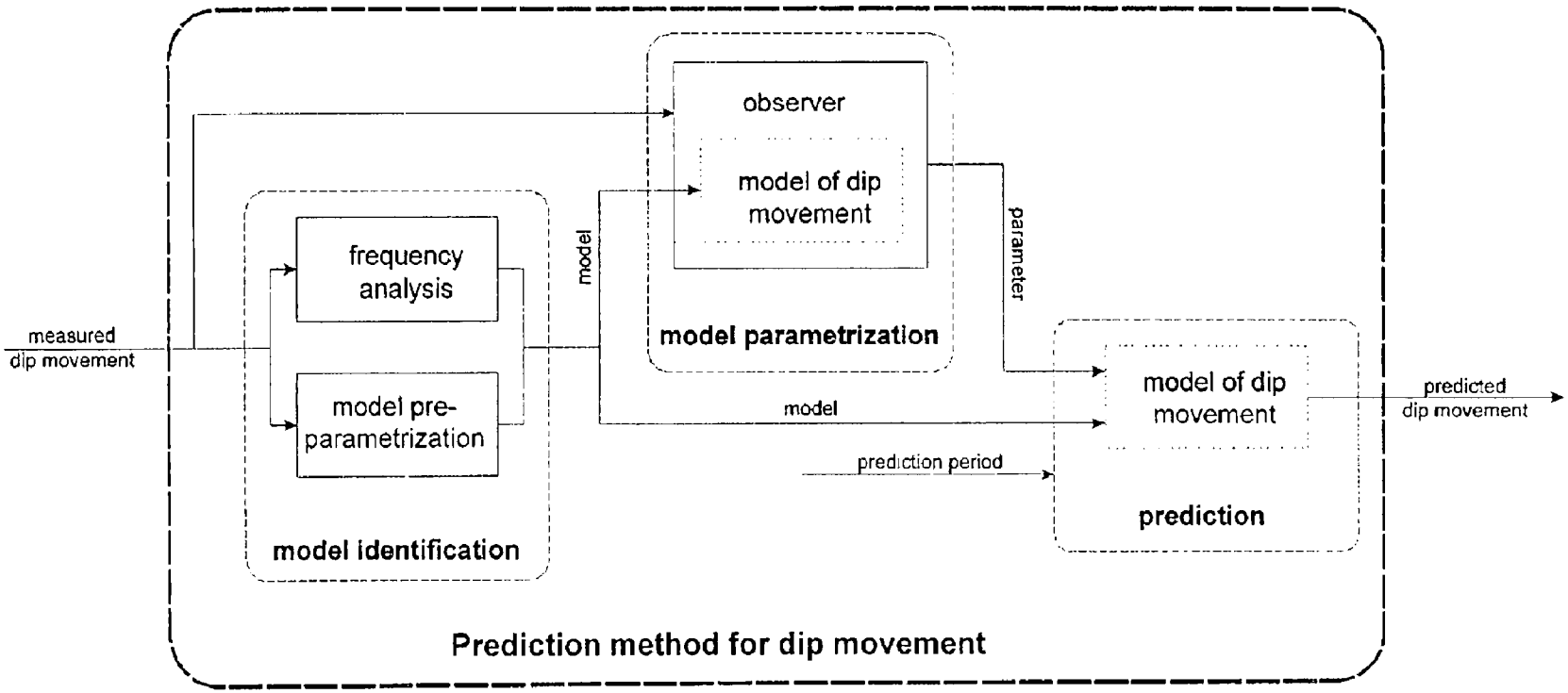
FIG. 4 shows a schematic diagram of an embodiment of a prediction method in accordance with the present invention.

In terms of structure, the method is designed in accordance with the signal flow diagram of FIG. 4. The heave movement is regarded as a periodic movement. Its model thus is formed by a superposition of N sinusoidal vibrations, which in the following are referred to as modes. Each mode is described completely by its amplitude A, angular frequency $\omega_M$ and phase $\Phi_M$.

For the online identification of the model of the heave movement, a frequency analysis of the measured heave movement is made as a first step. With reference to the same, a preliminary parametrization of the completely identified model is performed in addition. This model then serves as a basis of a linear or non-linear observer and is updated in firmly defined intervals. The same performs the exact adaptation of the model parameters in consideration of the currently measured heave movement. With a knowledge of both the model and its parameters, it is the object of the prediction to calculate a forecast of the heave movement for a time in the future.

The objective of the model identification is to determine the basic structure of the model of the heave movement. The determination of the necessary number of modes N is based on an online discrete Fourier analysis of the measured heave movement at the time $t_i$ and subsequent evaluation. For this purpose, the significant frequencies of the heave movement are determined with reference to the amplitude response. This evaluation of the amplitude response is effected during the runtime of the measurement by means of peak detection. Beside the number of modes N to be used for model identification, the peak detection supplies the frequencies $\omega_N$ of the detected modes and a first estimate of the vector of the amplitudes. The phases of the modes then are determined separately from the phase response of the discrete Fourier transformation. If the model is provided with these parameters, it supplies the modeled heave movement.

By using the created state models of the heave movement, the desired parameter adaptation is equal to an estimation of the current system condition. The problem of the model parametrization hence can be formulated analogous to an observation task. An observer always has the task to estimate the complete state of a section from the measured output variables of a section with sensors. The state sought for is determined by means of a model of the section, which is corrected with reference to the differences between the real and simulated output signals.

By means of observers making an online comparison, a correct prediction of the measured heave movement for prediction periods smaller than 2 s can be made. If it is also taken into consideration that the required task of prediction is the compensation of dead times in the range of about 0.5 s, the prediction method presented here offers optimum conditions for this objective.

In the following, modeling the dip movement now is illustrated in greater detail:

To be able to predict the dip movement of the load suspension, this movement must be modeled. As has already been assumed when measuring the movement of the ship, the dip movement can be regarded as a periodic movement. Its model hence is formed from a superposition of $N_M$ sinusoidal vibrations, which in the following are referred to as modes. Each mode is described completely by its amplitude $A_{M,k}$, angular frequency $\omega_{M,k}$ and phase $\phi_{M,k}$. In addition, a static offset $Z_{LA,off}$ must be added to the model, since the rest position of the dip movement need not be located in the origin of the z-axis of the world coordinate system. The modeled dip movement of the load suspension $Z_{LA}$, with the chosen starting time $t_0=0$, hence is described as follows without restriction of generality:

$$z_{LA}(t) = \sum_{k=1}^{N_M} z_{LA,k}(t) + z_{LA,off} = \sum_{k=1}^{N_M} A_{M,k}\sin(\omega_{M,k}t + \phi_{M,k}) + z_{LA,off} \quad 5.1$$

Since this model of the dip movement, as already briefly referred to above, should be used in a state observer, it is necessary to therefrom generate a state model.

Linear State Model of the Dip Movement

For the linear observer, a model structure is desired, which corresponds to the general description of a linear system without direct reach-through as represented in equation 5.2:

$$\dot{\underline{x}}=\underline{A}\underline{x}+\underline{B}\underline{u},\ \underline{x}(0)=\underline{x}_0,\ \underline{x}\in\mathbb{R}^n,\ \underline{u}\in\mathbb{R}^p\ \underline{y}=\underline{C}\underline{x},\ \underline{y}\in\mathbb{R}^m \quad 5.2$$

x designates the vector of the states of the system of the order n with the starting conditions $x_0$ at the time $t_0$, which are chosen as zero without restriction of the general validity. u stands for the p inputs of the system. Matrix A is referred to as system matrix, B as control matrix and C as measurement matrix. y characterizes the system output, which consists of m different measurement signals. If a single mode $Z_{LA,k}$ from equation 5.1 is represented as a linear system of differential equations analogous to equation 5.2, the same must be modeled as a free, undamped vibration. By choosing the states $$\underline{x}_k = [\,x_{1,k}\quad x_{2,k}\,]^T = [\,z_{LA,k}\quad \dot{z}_{LA,k}\,]^T,\quad k=1,\ldots,N_M \quad 5.3$$

$$= \begin{bmatrix} A_{M,k}\sin(\omega_{M,k}t+\phi_{M,k}) \\ \omega_{M,k}A_{M,k}\cos(\omega_{M,k}t+\phi_{M,k}) \end{bmatrix}.\quad k=1,\ldots,N_M \quad 5.4$$

an autonomous system with only one output is obtained, whose system equation must be set up as follows:

$$\dot{\underline{x}}_k = \underline{A}_k\underline{x}_k = \begin{bmatrix} 0 & 1 \\ -\omega_{M,k}^2 & 0 \end{bmatrix}\underline{x}_k \quad 5.5$$

$$\underline{x}_{0,k} = \begin{bmatrix} A_{M,k}\sin(\phi_{M,k}) \\ \omega_{M,k}A_{M,k}\cos(\phi_{M,k}) \end{bmatrix}$$

$$y_k = \underline{C}_k\underline{x}_k = [\,1\quad 0\,]\underline{x}_k.$$

$$k=1,\ldots,N_M$$

The scalar output $y_k$ describes the k-th mode. If the individual modes are added up and the static offset is added to the model as last state of the system description, the linear model of the dip movement of the load suspension is composed of the individual modes according to equation 5.5 as follows:

$$\dot{\underline{x}} = \underbrace{\begin{bmatrix} \underline{A}_1 & \underline{0} & \ldots & \ldots & 0 \\ \underline{0} & \underline{A}_2 & \ddots & & \vdots \\ \vdots & \ddots & \ddots & \ddots & \vdots \\ \vdots & & \ddots & \underline{A}_{N_M} & 0 \\ \underline{0} & \ldots & \ldots & \underline{0} & 0 \end{bmatrix}}_{\underline{A}}\underline{x} \quad 5.6$$

-continued $$\underline{x}_0 = \begin{bmatrix} \underline{x}_{0,1} \\ \underline{x}_{0,2} \\ \vdots \\ \underline{x}_{0,N_M} \\ z_{LA,off} \end{bmatrix}$$

$$y = \underbrace{[\,\underline{C}_1 \quad \underline{C}_2 \quad \dots \quad \underline{C}_{N_M} \quad 1\,]}_{\underline{C}}\underline{x}$$

It should be noted that the system output y in equation 5.6 is chosen such that the same describes the dip movement of the load suspension point.

A general, non-linear SISO system without direct reach-through is described as state model by the following system of differential equations:

$$\dot{\underline{x}} = \underline{f}(\underline{x},u),\ t>0,\ \underline{x}(0)=\underline{x}_0,\ \underline{x}\in M_n \subseteq \mathbb{R}^n,\ u\in U_1 \subseteq \mathbb{R}^1\ y = h(\underline{x}),\ t\leqq 0,\ y\in Y_1 \subseteq \mathbb{R}^1 \qquad 5.7$$

n stands for the order of the system with the output y. The states y and their starting conditions $x_0$ are located in the natural working space of a non-linear system $M_n$, which is described by the n-dimensional variety. The input of the system u is located in the admissible set of the input functions $U_1$. The dynamics of the system is described by the vector field f(x), which thus is the non-linear analogue of the system matrix A of the linear systems. h(x) stands for the output function of the system and can be compared with the measurement matrix C of the linear systems. If the dip movement of the load suspension point according to equation 5.1 should be indicated in the form described above, it in turn is recommendable to first consider only a single mode. With the definition of the states as chosen below $$\underline{x}_k = [\,x_{1,k} \quad x_{2,k} \quad x_{3,k}\,]^T = [\,z_{LA,k} \quad \dot{z}_{LA,k} \quad \omega_{M,k}\,]^T,\quad k = 1, \dots, N_M \qquad 5.8$$

$$= \begin{bmatrix} A_{M,k}\sin(\omega_{M,k}t + \phi_{M,k}) \\ \omega_{M,k}A_{M,k}\cos(\omega_{M,k}t + \phi_{M,k}) \\ \omega_{M,k} \end{bmatrix},\qquad k = 1, \dots, N_M \qquad 5.9$$

the autonomous non-linear model of the k-th mode is obtained as:

$$\dot{\underline{x}}_k = \underline{f}_k(\underline{x}_k) = \begin{pmatrix} x_{2,k} \\ -x_{1,k}x_{3,k}^2 \\ 0 \end{pmatrix},\qquad 5.10$$

$$\underline{x}_{0,k} = \begin{bmatrix} A_{M,k}\sin(\phi_{M,k}) \\ \omega_{M,k}A_{M,k}\cos(\phi_{M,k}) \\ \omega_{M,k} \end{bmatrix}$$

$$y_k = h_k(\underline{x}_k) = x_{1,k}$$

$$k = 1, \dots, N_M$$

The complete, non-linear model of the dip movement of the load suspension point in turn results from the combination of the models of the individual modes from equation 5.10 and the introduction of an offset state. If the same is included in the model as last and hence $3N_M+1$-th state, the description of the entire system reads as follows:

$$\dot{\underline{x}} = \underline{f}(\underline{x}) = \begin{pmatrix} \underline{f}_1(x_1) \\ \vdots \\ \underline{f}_{N_M}(x_{N_M}) \\ 0 \end{pmatrix} \qquad 5.11$$

$$\underline{x}_0 = \begin{pmatrix} \underline{x}_{0,1} \\ \vdots \\ \underline{x}_{0,N_M} \\ z_{LA,off} \end{pmatrix}$$

$$y = h(\underline{x}) = \sum_{k=1}^{N_M} h_k(x_k) + x_{3N_M+1}$$

The single output of the entire system is chosen such that the same describes the dip movement of the load suspension.

Model Identification and Pre-Parametrization

The objective of the model identification is to determine the basic structure of the model of the dip movement. Since the same is specified already except for the number of modes, it is merely necessary to determine their number. It is the object of the pre-parametrization of the model to adapt the parameters of the identified model as correctly as possible.

Looking at equation 5.1, the dip movement is described completely with a knowledge of the parameters $N_M$, $A_{M,k}$, $\omega_{M,k}$, $\phi_{M,k}$ and $Z_{LA,off}$. The number of parameters to be determined thus is $3N_M+2$. Hence it is linearly dependent on the number of sinusoidal vibrations, which are required to model the dip movement. Determining $N_M$ hence is the first and foremost task, since it is similar to model identification. Once the number of modes and hence the model of the dip movement is known, the remaining $3N_M+1$ parameters can successively be adapted.

Figure 5:
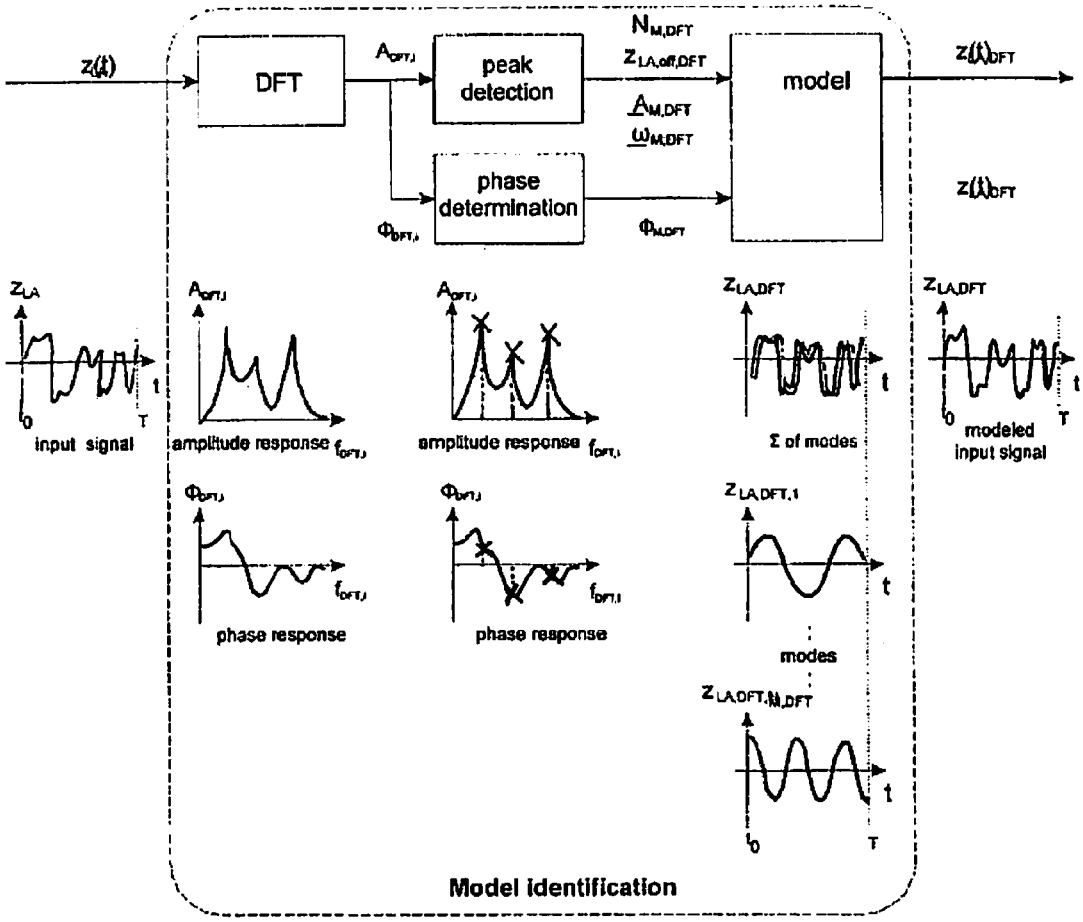
FIG. 5 shows a schematic diagram of a model identification and pre-parametrization in the embodiment of a prediction method in accordance with the present invention.

The identification and pre-parametrization of the model of the dip movement is performed with reference to the measured vertical movement of the load suspension point. The structural procedure is shown in FIG. 5. The determination of the necessary number of modes $N_M$ is based on an online discrete Fourier analysis of the measured dip movement at the time $t_i$ and subsequent evaluation.

The significant frequencies of the dip movement are determined with reference to the amplitude response. This evaluation of the amplitude response is effected during the runtime of the measurement by means of peak detection. Beside the number of modes $N_{M,DFT}$ to be used for model identification, the peak detection supplies the frequencies of the detected modes $\omega_{M,DFT,k}$, which are combined to the vector $\omega_{M,DFT}$, and a first estimate of the vector of the amplitudes $A_{M,DFT}$. The phases of the modes $\phi_{M,DFT}$ then are determined separately from the phase response of the discrete Fourier transformation. If the model is provided with these parameters, it supplies the modeled dip movement in the time domain between $t_0$ and T, which is designated with $Z_{LA,DFT}$.

By means of a discrete Fourier transformation (DFT), the amplitude response $A_{DFT,i}$ and the phase response $\phi_{DFT,i}$ are determined from $z_{LA}(t)$ via the time-discrete signal $z_{LA,n}$. For instance, the discrete Fourier transformation can be applied to the real dip movement of the load suspension every 10 seconds.

Peak Detection

The amplitude spectrum of the dip movement of the load suspension point, which has been determined online with the discrete Fourier transformation, now must be evaluated by means of peak detection. Almost all information necessary for identification and pre-parametrization of the model of the dip movement can be recovered therefrom.

Objectives of Peak Detection

The main task of peak detection is to identify the state model of the dip movement.

This includes the following objectives:

online identification of the model of the dip movement
- determination of the number of modes $N_{M,SE}$
- modeling in consideration of the maximum number of modes $N_{M,max}$ online parametrization of the model of the dip movement
- determination of the amplitudes $A_{M,DFT}$ of the modes
- determination of the angular frequencies $\omega_{M,DFT}$ of the modes The problem of the detection of the modes is solved by way of example by a minimax task with side condition applied to the amplitude response. As side condition, a so-called limit sequence is used. It determines the minimum amplitude, which must exceed a maximum, in order to be recognized as a mode. Determining the amplitude of the limit sequence $A_{DFT,limit,i}$ is effected adaptively in dependence on the respective amplitude spectrum of the current dip movement according to the following equation:

$$A_{DFT,limit,i} = \underbrace{c_{limit} A_{DFT,max}}_{offset\ shift} + \underbrace{\frac{1}{6}\left(\sum_{j=1}^{3} A_{DFT,j} + A_{DFT,-j}\right)}_{averaging} \quad i = 4, 5, \ldots, \frac{N_{DFT}}{2} \qquad 5.23$$

The same thus is structurally calculated by means of offset shift and averaging. Offset shift defines a minimum amplitude of the limit sequence, which is constant over the entire frequency spectrum. It is formed from the product between the freely selectable design parameter $c_{limit}$ and the absolute maximum of the amplitude response $A_{DFT,max}$, which is determined analogous to equation 5.24.

$$A_{DFT,Max} = \max\{A_{DFT,i}\},\ i = 1, 2, \ldots, \frac{N_{DFT}}{2} \qquad 5.24$$

The second part is the formation of a moving average applied to a restricted frequency band of the amplitude spectrum. The filter used for this purpose is designed similar to the filters used in image processing. Since it is not possible due to averaging to calculate the first four amplitudes of the limit sequence analogous to the presented equation, the same must be determined separately. For simplicity, the same were chosen corresponding to the last determinable amplitude, so that the initial values of the limit sequence are obtained as $$A_{DFT,limit,i} = A_{DFT,limit,A}\ i=0,1,2,3 \qquad 5.25$$

The local maxima of the amplitude response of the dip movement are determined by a discrete differentiation thereof. A peak of the amplitude response at the point i hence is recognized as such, if:

$$\begin{pmatrix} A_{DFT,i} - \\ A_{DFT,i-1} > 0 \end{pmatrix} \wedge \begin{pmatrix} A_{DFT,i+1} - \\ A_{DFT,i} < 0 \end{pmatrix},\ i = 1, \ldots, \frac{N_{DFT}}{2} - 1 \qquad 5.26$$

If the amplitude of the peak thus detected also exceeds the amplitude of the limit sequence, the same is detected as mode $M_{SE,i}$. The set of all modes $M_{M,SE}$ hence is determined as follows:

$$M_{M,SE} = \{M_{SE,i} \mid (A_{DFT,i} - A_{DFT,i-1} > 0) \wedge \ldots (A_{DFT,i+1} - A_{DFT,i} < 0) \wedge \ldots (A_{DFT,j} > A_{DFT,limit,i})\},\ i = 1, \ldots, \frac{N_{DFT}}{2} - 1 \qquad 5.27$$

The number of modes $N_{M,SE}$ to be determined now can be determined from the cardinality of the set $M_{M,SE}$.

$$N_{M,SE} = |M_{M,SE}| \qquad 5.28$$

Upon determination of the number of detected modes $N_{M,SE}$, it must be checked whether the same is equal to or smaller than the chosen maximum number of modes $N_{M,max}$. If this case occurs, a model of the dip movement must be used, which considers $N_{M,SE}$ modes. Otherwise, the number of modes considered is limited to $N_{M,max}$, so that the number of modes $N_{M,DFT}$ used for modeling is determined as follows:

$$N_{M,DFT} = \min\{N_{M,SE}, N_{M,Max}\} \qquad 5.29$$

If the models according to equations 5.1, 5.6 and 5.11 are used for modeling the dip movement, the same are identified completely with a knowledge of the number of modes to be considered.

The pre-parametrization of the models now must be performed with the set of modes $M_{M,DFT}$ used for model identification. The same is equal to the set of modes $M_{M,SE}$ detected, if $N_{M,SE} \leqq N_{M,max}$. Otherwise, it is that subset which contains the $N_{M,max}$ modes with the greatest amplitude.

The amplitude of the k-th mode $A_{M,SE,k}$ is determined by its value in the amplitude response. As explained already in the introduction of the amplitude response, it is distributed in the frequency spectrum over two points with identical height. Thus, it is obtained as $$A_{M,SE,k} = 2A_{DFT,i} \quad \forall\, i \in \{i \mid M_{SE,i} \in M_{M,SE}\} \quad i = 0, 1, \ldots, \frac{N_{DFT}}{2} \qquad 5.30$$

and the amplitudes of the modes of the model are obtained as $$A_{M,DFT,k} = 2A_{DFT,i} \quad \forall\, i \in \{i \mid M_{SE,i} \in M_{M,DFT}\} \quad i = 0, 1, \ldots, \frac{N_{DFT}}{2}. \qquad 5.31$$

In accordance with the present paper, the selection of the dominant modes is performed by a sorting algorithm applied to the amplitudes of the modes. It should be noted that the allocation between amplitude, frequency and phase of a mode is not lost by resorting the modes. As a last task of peak detection, the angular frequencies $\omega_{M,DFT}$ of the modes must be determined. The same are determined with reference to the frequency axis of the amplitude spectrum with the following conversion:

$$\omega_{M,DFT,k} = 2\pi f_{DFT,i} \quad 5.32$$

$$\forall\, i \in \{i \mid M_{DFT,i} \in M_{M,DFT}\}$$

$$i = 0, 1, \ldots, \frac{N_{DFT}}{2}$$

Determination of the Static Offset

For determining the static offset of the dip movement of the load suspension point, the amplitude response determined online for this movement must be used. The constant component of the sequence of measurement data provided for the discrete Fourier transformation corresponds to the first value of the amplitude response. For the mathematical justification, equation 5.16 must be used. If i is chosen as zero, with which the first value of the amplitude response is calculated, the following is obtained:

$$z_{LA,\underline{off},DFT} = A_{DFT,0} = \frac{1}{N_{DFT}} \sum_{n=0}^{N_{DFT}-1} z_{LA,n} \quad 5.33$$

This corresponds to the arithmetic mean of the sequence of measurement data added up and hence to the static offset of the dip movement in the observed time interval.

Phase Determination

The determination of the phases of the individual modes completes the pre-parametrization of the model of the dip movement. They are determined by evaluation of the phase response.

For determining the phase, a retransformation of the image sequence into the time domain must be performed. If the complete image sequence of the measured dip movement $z_{LA,i}$ is transferred into the time domain by applying the transformation rule according to equation 5.15, the starting value of the dip movement $z_{LA,0}$ is obtained as:

$$z_{LA,0} = z_{LA}(0) = \frac{1}{N_{DFT}} \sum_{i=0}^{N_{DFT}-1} Z_{LA,i} \quad 5.34$$

Figure 6:
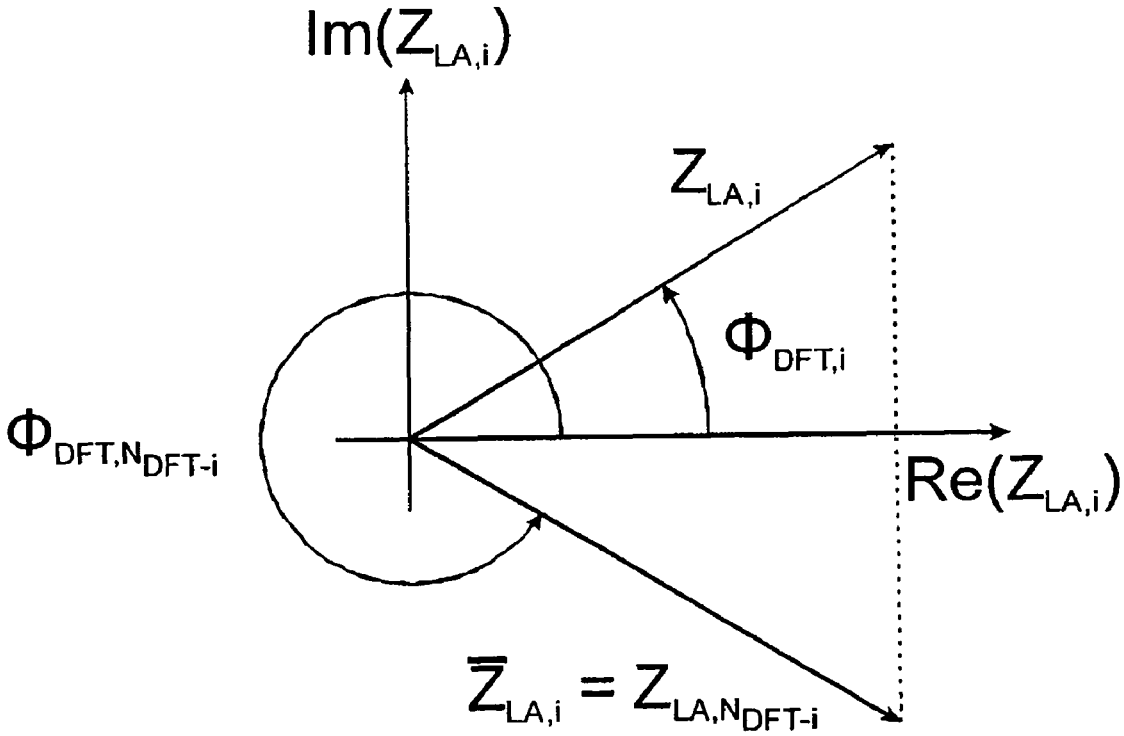
FIG. 6 shows a representation of the i-th value of the image sequence and its complex conjugate value at the point $N_{DFT}-i$ during the phase determination for pre-parametrization in the embodiment of a prediction method in accordance with the present invention.

For a single mode, this expression is simplified considerably and ultimately can be represented in dependence on a single value of the amplitude response $A_{DFT,i}$ and of the phase response $\phi_{DFT,i}$. This simplification is based on the property that in the transformed domain of the Fourier transformation a pure sinusoidal vibration is described by a complex conjugate number pair, whose values are localized at the i-th and $N_{DFT-i}$-th position of the sequence. To illustrate the further steps, this number pair is shown in FIG. 6 (representation of the i-th value of the image sequence and its complex conjugate value at the point $N_{DFT-i}$).

The starting values $Z_{LA,0,k}$ of the $N_{M,DFT}$ modes thus are determined by the following equations:

$$\begin{aligned} z_{LA,k,0} &= \frac{1}{N_{DFT}}(Z_{LA,i} + Z_{LA,N_{DFT}-i}) \\ &= \frac{1}{N_{DFT}}(Z_{LA,i} + \overline{Z}_{LA,i}) \\ &= \frac{2}{N_{DFT}}\mathrm{Re}(Z_{LA,i}) \\ &= 2A_{DFT,i}\cos(\phi_{DFT,i}). \end{aligned} \quad 5.35$$

$$k = 1, \ldots, N_{M,DFT}$$

$$i \in \{i \mid M_{DFT,i} \in M_{M,DFT}\}$$

If the starting values of the modes of the dip movement determined in this way are compared with the following starting values $$z_{LA,k}(0) = \underbrace{A_{M,DFT,k}}_{=2A_{DFT,i}\,cf.\,eq.\,5.30} \sin(\phi_{M,DFT,k}),\ k = 1, \ldots, N_{M,DFT} \quad 5.36$$

from equation 5.1, the sought-for phases of the modes $\phi_{M,DFT}$ at the time $t_0$ are obtained as $$\phi_{M,DFT,k} = \phi_{DFT,i} + \frac{\pi}{2}. \quad 5.37$$

$$i \in \{i \mid M_{DFT,i} \in M_{M,DFT}\}.$$

Observer-Based Adaptation of the Model Parameters

Figure 7:
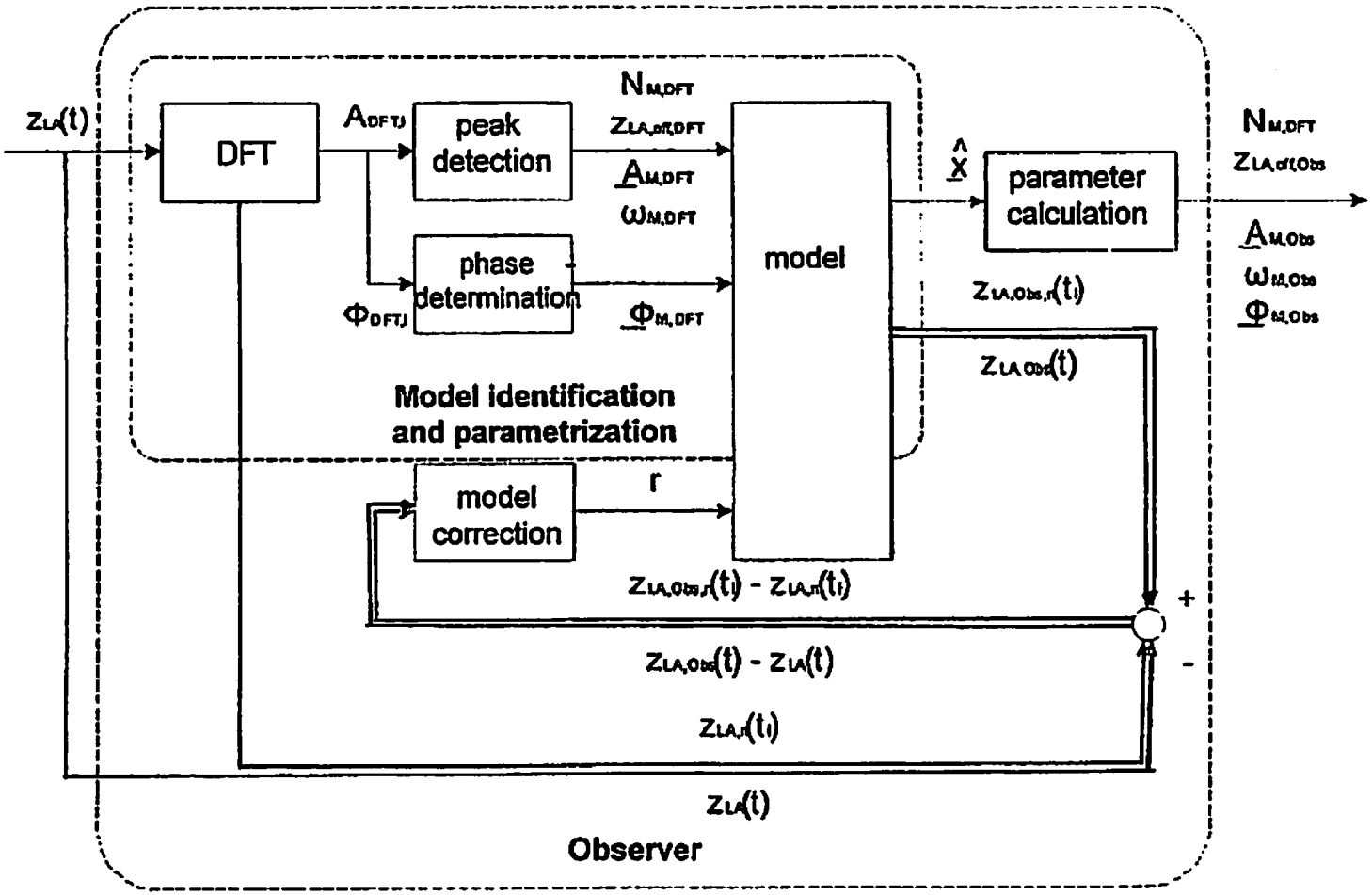
FIG. 7 shows a schematic diagram of the correction of the model identification and pre-parametrization by means of an observer in the embodiment of a prediction method in accordance with the present invention.

For adaptation of the amplitude, phase and possibly the frequency, observer-based approaches are used. An observer always has the task of estimating the complete state of a section from the measured output variables of a section with sensors. The sought-for state x is determined by means of a model of the section, which is corrected with reference to the differences between the real y and simulated ŷ output signals. FIG. 7 shows a signal flow diagram of such an observer.

Linear Observer Design

The linear observer design is based on the state model of the dip movement according to equation 5.6. The linear Kalman-Bucy filter is one of the most frequently used observers, which are based on the structure of the Luenberger observer. For the observer design, system noise w(t) and measurement noise v(t) must be considered, so that the following model should be used for the design process:

$$\begin{aligned} \dot{\underline{x}} &= \underline{A}\underline{x} + \underline{B}\underline{u} + \underline{w}(t),\ \underline{x}(0) = \underline{x}_0,\ \underline{x} \in \mathbb{R}^n,\ \underline{w}(t) \in \mathbb{R}^n,\ \underline{u} \in \mathbb{R}^p \\ \underline{y} &= \underline{C}\underline{x} + \underline{v}(t),\ \underline{y} \in \mathbb{R}^m,\ \underline{v}(t) \in \mathbb{R}^m \end{aligned} \quad 5.55$$

It is assumed that the noise signals are stationary, mean-free, normally distributed and also uncorrelated signals. For this noise, the following applies $$E\{\underline{w}(t_1)\underline{w}^T(t_2)\} = \mathrm{cov}\{\underline{w}(t_1)\underline{w}^T(t_2)\} = \underline{Q}\delta(t_1 - t_2) \quad 5.56$$

$$E\{\underline{v}(t_1)\underline{v}^T(t_2)\} = \mathrm{cov}\{\underline{v}(t_1)\underline{v}^T(t_2)\} = \underline{R}\delta(t_1 - t_2). \quad 5.57$$

so that the covariance matrices Q and R are unambiguously described by the noise signals. The same form constant, symmetrical matrices. Hence, the following equations are obtained for the observer:

$$\dot{\hat{\underline{x}}} = \underbrace{\underline{A}\hat{\underline{x}} + \underline{B}\underline{u}}_{simulation\ part} + \underbrace{\underline{L}(\underline{y} - \hat{\underline{y}})}_{correction\ part\ \underline{r}} \quad 5.58$$

-continued $$= (A - \underline{L}C)\hat{x} + Bu + \underline{L}y, \quad \hat{x}_0 = E\{x_0\}$$

The correction matrix L of the linear Kalman-Bucy filter is calculated by solving the subsequent quadratic quality criterion:

$$\underline{L} = \underline{P}\underline{C}^T\underline{R}^{-1} \tag{5.59}$$

$$\underline{0} = \underline{P}\underline{C}^T\underline{R}^{-1}\underline{C}\underline{P} - \underline{A}\underline{P} - \underline{P}\underline{A}^T - \underline{Q} \tag{5.60}$$

The model of the linear Kalman-Bucy filter then is:

$$\dot{\hat{x}} = \left( \begin{bmatrix} \underline{A}_1 & \underline{0} & \cdots & \cdots & 0 \\ \underline{0} & \underline{A}_2 & \ddots & & \vdots \\ \vdots & \ddots & \ddots & \ddots & \vdots \\ \vdots & & \ddots & \underline{A}_{N_{M,DFT}} & 0 \\ \underline{0} & \cdots & \cdots & \underline{0} & 0 \end{bmatrix} - \underline{L}[\,\underline{C}_1 \;\; \underline{C}_2 \;\; \cdots \;\; \underline{C}_{N_{M,DFT}} \;\; 1\,] \right) \hat{x} + \underline{L}y \tag{5.61}$$

Analogous to equation 5.5, the individual block matrices, of which system matrix A and measurement matrix C are composed, read as follows:

$$\underline{A}_k = \begin{bmatrix} 0 & 1 \\ -\omega^2_{M,DFT,k} & 0 \end{bmatrix}, k = 1, \ldots, N_{M,DFT} \tag{5.62}$$

$$\underline{C}_k = [\,1 \quad 0\,], k = 1, \ldots, N_{M,DFT} \tag{5.63}$$

As output of the section y, the partial sequence of the stored measurement data of the dip movement is used, which corresponds to the chosen observation interval, so that $$y(t) = z_{LA,n}(t_i),\ t_n = t_0 + n\Delta T_{DFT}\ t_{0,Obs} \leqq t_n \leqq T \tag{5.64}$$

For a fast transient behavior of the observer, the same should be supplied with rather correct starting conditions $\hat{x}_0$ for the time $t_{0,obs}$. The same are calculated from the parameters of the individual modes determined with the discrete Fourier transformation and from the static offset, as follows:

$$\underline{\dot{x}}_0 = \underline{\dot{x}}(t_{o,Obs}) = \begin{bmatrix} \underline{\dot{x}}_{0,1} \\ \underline{\dot{x}}_{0,2} \\ \vdots \\ \underline{\dot{x}}_{0,N_{M,DFT}} \\ z_{LA,off,DFT} \end{bmatrix} \tag{5.65}$$

With:

-continued $$\underline{\hat{x}}_{o,k} = \begin{bmatrix} A_{M,DFT,k}\sin(\omega_{M,DFT,k}t_{0,Obs} + \phi_{M,DFT,k}) \\ \omega_{M,DFT,k}A_{M,DFT,k}\cos(\omega_{M,DFT,k}t_{o,Obs} + \phi_{M,DFT,k}) \end{bmatrix}, \tag{5.66}$$

$$k = 1, \ldots, N_{M,DFT}$$

For calculating L, the design parameters Q and R now are chosen symmetrically and positively definite. Their dimensions are determined by the number of system states and the outputs of the observer model. Hence, Q must be chosen as a $(2N_{M,DFT}+1\times 2N_{M,DFT}+1)$ matrix and R as a scalar. If only the diagonal elements of the covariance matrix Q are described, the dynamics of the error correction can be specified separately for each mode on the basis of the prevailing structure of the system matrix A. The greater the trace of the k-th block matrix $Q_k$ is chosen, the faster the correction of the corresponding deviations of the states $\hat{x}_k$ of the mode. The design parameter R, however, influences the dynamics of all states to the same extent. The smaller R is chosen, the more dynamic will the observer react to differences between the measured and the simulated dip movement.

The covariance matrix Q used in this paper for estimating the individual modes of the dip movement is constructed according to the following equation:

$$\underline{Q} = \begin{bmatrix} \underline{Q}_1 & \underline{0} & \cdots & \cdots & 0 \\ \underline{0} & \underline{Q}_2 & \ddots & & \vdots \\ \vdots & \ddots & \ddots & \ddots & \vdots \\ \vdots & & \ddots & \underline{Q}_{N_{M,DFT}} & 0 \\ \underline{0} & \cdots & \cdots & \underline{0} & c_{off} \end{bmatrix} \tag{5.67}$$

The individual block matrices $Q_k$ in turn are constructed as diagonal matrices and are determined as follows:

$$\underline{Q}_k = \begin{bmatrix} c_k & 0 \\ 0 & c_k \end{bmatrix}, \tag{5.68}$$

$$k = 1, \ldots, N_{M,DFT} \tag{5.69}$$

The factor $c_k$ of the covariance matrices $Q_k$ is determined in dependence on the angular frequency of the associated mode.

TABLE 5.2

Entries of the covariance matrix Q in dependence on the angular frequency $\omega_{M,DFT,k}$

| $\omega_{Min}$ [rad/s] | $\omega_{Max}$ [rad/s] | $\omega_{Min}$ [rad/s] | $\omega_{Max}$ [rad/s] | $\omega_{Min}$ [rad/s] | $\omega_{Max}$ [rad/s] | $\omega_{Min}$ [rad/s] | $\omega_{Max}$ [rad/s] |
|---|---|---|---|---|---|---|---|
| 0 | $\frac{2\pi}{40}$ | $\frac{2\pi}{40}$ | $\frac{2\pi}{20}$ | $\frac{2\pi}{20}$ | $\frac{2\pi}{10}$ | $\frac{2\pi}{10}$ | $\chi$ |
| $c_k = 0.001$ | | $c_k = 0.01$ | | $c_k = 0.5$ | | $c_k = 3$ | |

$\omega_{Min} \leqq \omega_{M,DFT,k} < \omega_{Max}$

Non-Linear Observer Design

For the non-linear observer design, the state model of the dip movement, as indicated in equation 5.11, should be used. The extended Kalman filter is a variant of the linear Kalman-Bucy filter extended for non-linear systems. As a basis for the observer design, the non-linear SISO system according to equation 5.7 hence must be formulated as follows:

$$\dot{\underline{x}}=\underline{f}(\underline{x},u)+\underline{w}(t),\ \underline{x}(0)=\underline{x}_0,\ \underline{x}\in M_n\subseteq \mathbb{R}^n,\ \underline{w}(t)\in\mathbb{R}^n,\ u\in U_1\subseteq \mathbb{R}$$

$$y=h(\underline{x})+v(t),\ y\in Y_1\subseteq \mathbb{R},\ v(t)\in\mathbb{R} \qquad 5.95$$

According to equations 5.56 and 5.57, the description of the covariance matrices Q and R in turn is effected by noise processes, which are assumed to be stationary, mean-free, normally distributed and also uncorrelated.

$$E\{\underline{w}(t_1)\underline{w}^T(t_2)\}=\mathrm{cov}\{\underline{w}(t_1)\underline{w}^T(t_2)\}=\underline{Q}\delta(t_1-t_2) \qquad 5.96$$

$$E\{v(t_1)v^T(t_2)\}=\mathrm{cov}\{v(t_1)v^T(t_2)\}=\underline{R}\delta(t_1-t_2), \qquad 5.97$$

If the system or measurement noise is not known, these two matrices must be used as design parameters. The extended Kalman filter belonging to equation 5.95 is described by the following non-linear system of differential equations:

$$\dot{\hat{\underline{x}}}=\underbrace{\underline{f}(\hat{\underline{x}},u)}_{\text{simulation part}}+\underbrace{\underline{L}(t)(y-\hat{y})}_{\text{correction part }\underline{r}} \qquad 5.98$$

$$=\underline{f}(\hat{\underline{x}},u)+\underline{L}(t)(y-h(\hat{\underline{x}})),\ \hat{\underline{x}}_0=E\{\underline{x}_0\}$$

For this observer differential equation, with the noise-free simulation part and the correction part r, the time-varying correction matrix L(t) must be determined. The same is calculated in dependence on the covariance matrices Q and R from the following matrix Riccati differential equation.

$$\underline{L}=\underline{P}\underline{H}^T\underline{R}^{-1}.\quad \underline{H}(t)=\left.\frac{\partial h}{\partial \underline{x}}\right|_{\hat{\underline{x}}(t)} \qquad 5.99$$

$$\dot{\underline{P}}=\underline{F}\underline{P}+\underline{P}\underline{F}^T+\underline{Q}-\underline{P}\underline{H}^T\underline{R}^{-1}\underline{H}\underline{P}.\quad \underline{F}(t)=\left.\frac{\partial \underline{f}}{\partial \underline{x}}\right|_{\hat{\underline{x}}(t)} \qquad 5.100$$

With the choice of the starting condition $P_0$ of the covariance matrix P as $$\underline{P}(0)=\underline{P}_o=E\{(\hat{\underline{x}}_0-\underline{x}_o)(\underline{x}_o-\underline{x}_o)^T\} \qquad 5.101$$

the extended Kalman filter is determined completely.

For realizing the extended Kalman filter, it hence is necessary to integrate the n non-linear filter equations. For determining the correction matrix, the Jacobi matrices H(t) and F(t) must also be calculated, and the n(n+1)/2 differential equations of the symmetric covariance matrix P must also be solved. All this must be effected online, whereby the required calculation effort greatly increases with the order of the system. By inserting the non-linear model of the dip movement 5.11 identified online, the filter differential equations according to 5.98 are obtained as:

$$\dot{\hat{\underline{x}}}=\begin{pmatrix}\underline{f}_1(\underline{x}_1)\\ \vdots\\ \underline{f}_{N_{M,DFT}}(\underline{x}_{N_{M,DFT}})\\ 0\end{pmatrix}+\underline{L}(t)\left(y-\left(\sum_{k=1}^{N_{M,DFT}}h_k(x_k)+x_{3N_{M,DFT}+1}\right)\right) \qquad 5.102$$

The individual vector fields $f(x_k)$ of the $N_{M,DFT}$ detected modes and the starting functions $h_k(x_k)$ can be described analogous to equation 5.10.

$$\underline{f}_k(x_k)=\begin{pmatrix}x_{2,k}\\ -x_{1,k}x_{3,k}^2\\ 0\end{pmatrix},\quad k=1,\ldots,N_{M,DFT} \qquad 5.103$$

$$h_k(x_k)=x_{1,k},\quad k=1,\ldots,N_{M,DFT} \qquad 5.104$$

In addition, the starting conditions of the filter equation 5.102 with the parameters of the modes determined by means of the discrete Fourier transformation are calculated as follows:

$$\hat{\underline{x}}_0=\begin{bmatrix}\hat{\underline{x}}_{0,1}\\ \hat{\underline{x}}_{0,2}\\ \cdots\\ \hat{\underline{x}}_{0,N_{M,DFT}}\end{bmatrix} \qquad 5.105$$

With:

$$x_{0,k}=\begin{bmatrix}A_{M,DFT,k}\sin(\phi_{M,DFT,k})\\ \omega_{M,DFT,k}A_{M,DFT,k}\cos(\phi_{M,DFT,k})\\ \omega_{M,DFT,k}\end{bmatrix},\quad k=1,\ldots,N_{M,DFT} \qquad 5.106$$

For calculating the time-varying correction matrix L(t), the likewise time-varying Jacobi matrices H(t) and F(t) must be determined continuously from the state of the observer ˆx according to $$\underline{H}(t)=\begin{bmatrix}\underline{H}_1 & \underline{H}_2 & \cdots & \underline{H}_{N_{M,DFT}} & 1\end{bmatrix}, \qquad 5.107$$

$$\underline{F}(t)=\begin{bmatrix}\underline{F}_1 & \underline{0} & \cdots & \cdots & 0\\ \underline{0} & \underline{F}_2 & \ddots & & \vdots\\ \vdots & \ddots & \ddots & \ddots & \vdots\\ \vdots & & \ddots & \underline{F}_{N_{M,DFT}} & 0\\ \underline{0} & \cdots & \cdots & \underline{0} & 0\end{bmatrix}$$

The block matrices $H_k$ of the system output and the diagonally arranged block matrices $F_k$ are constructed as described below.

$$\underline{H}_k(t)=[1\ \ 0\ \ 0].\quad k=1,\ldots,N_{M,DFT} \qquad 5.108$$

$$\underline{F}_k(t)=\begin{bmatrix}0 & 1 & 0\\ -\hat{\underline{x}}_{3,k}^2 & 0 & -2\hat{\underline{x}}_{1,k}\hat{\underline{x}}_{3,k}\\ 0 & 0 & 0\end{bmatrix}.\quad k=1,\ldots,N_{M,DFT} \qquad 5.109$$

Finally, the design parameters of the extended Kalman filter must be specified. The same consist of the covariance matrices Q and R, which must be chosen symmetrically and positively definite. In addition, a suitable starting condition must be defined for $P_0$. Q hence in turn is set up as a diagonal matrix, whose entries are weighted depending on the frequency of the associated mode. The structure of the covariance matrix Q, as it is indicated in equation 5.110, hence is equal to the matrix Q used in the linear case.

$$\underline{Q} = \begin{bmatrix} \underline{Q}_1 & \underline{0} & \dots & \dots & 0 \\ \underline{0} & \underline{Q}_2 & \ddots & & \vdots \\ \vdots & \ddots & \ddots & \ddots & \vdots \\ \vdots & & \ddots & \underline{Q}_{N_{M,DFT}} & 0 \\ \underline{0} & \dots & \dots & \underline{0} & c_{off} \end{bmatrix} \quad 5.110$$

However, the individual block matrices $Q_k$ differ by their number of elements, since the non-linear model of the dip movement has three states per mode. Set up as a diagonal matrix, the same provide:

$$\underline{Q}_k = \begin{bmatrix} c_k & 0 & 0 \\ 0 & c_k & 0 \\ 0 & 0 & c_{\omega,k} \end{bmatrix}, \quad k = 1, \dots, N_{M,DFT} \quad 5.111$$

Finally, a suitable starting condition for the matrix Riccati differential equation $P_0$ must be specified. According to equation 5.101, the same is formed from the expected deviation between the state of the observer and the real system. By using the error estimates of the model identification, the same reads as follows $$\underline{P}_0 = E\left\{ \begin{bmatrix} \begin{bmatrix} (\tilde{x}_{0,1}) \\ (\tilde{x}_{0,1}) \\ \vdots \\ (\tilde{x}_{0,N_{M,DFT}}) \\ 0.5 \end{bmatrix} \\ \begin{bmatrix} (\tilde{x}_{0,1}) & (\tilde{x}_{0,2}) & \dots & (\tilde{x}_{0,N_{M,DFT}}) & 0.5 \end{bmatrix}^T \end{bmatrix} \right\} \quad 5.113$$

with the estimates of the individual state errors $x_{0,k}$ of the modes $$\tilde{x}_{0,k} = \hat{x}_{0,k} - x_{0,k} = \begin{bmatrix} 0,7A_{M,DFT,k} \\ 2\pi 0,002 \cdot 0,7A_{M,DFT,k} \\ 2\pi 0,002 \end{bmatrix}, \quad k = 1, \dots, N_{M,DFT} \quad 5.114$$

The calculation of the parameters of the modes is effected inversely with respect to the calculation of the starting condition $\hat{x}_0$ of both the linear and the non-linear state model. As calculation basis, the estimated condition of the model $\hat{x}(T)$ at the time T, i.e. the presence, is used. The same is adapted over the entire time interval of the observation from $t_{0,obs} \leqq t \leqq T$ with reference to the latest measurement data of the dip movement. Hence, all changes occurring up to this point are considered in the dynamics of the dip movement.

In the linear case, the two states of the k-th model according to equation 5.61 are defined as follows:

$$\underline{x}_{1,k}(t) = A_{M,Obs,k} \sin(\omega_{M,DFT,k} t + \phi_{M,Obs,k}), \quad k = 1, \dots, N_{M,DFT} \quad 5.115$$

$$\underline{x}_{2,k}(t) = \omega_{M,DFT,k} A_{M,Obs,k} \cos(\omega_{M,DFT,k} t + \phi_{M,Obs,k}), \quad k = 1, \dots, N_{M,DFT} \quad 5.116$$

$$\underline{x}_{2N_{M,DFT}+1}(t) = z_{LA,Obs}(t) \quad 5.117$$

If the two equations are resolved at the time T for $\phi_{M,obs,k}$ and $A_{M,obs,k}$, the following is obtained:

$$\phi_{M,Obs,k} = \arctan\left(\omega_{M,DFT,k} \frac{\hat{x}_{1,k}(T)}{\hat{x}_{2,k}(T)}\right) - \omega_{M,DFT,k} T, \quad k = 1, \dots, N_{M,DFT} \quad 5.118$$

$$A_{M,Obs,k} = \frac{\hat{x}_{1,k}(T)}{\sin(\omega_{M,DFT,k} T + \phi_{M,Obs,k})}, \quad k = 1, \dots, N_{M,DFT} \quad 5.119$$

It should be noted that the arc tangent only is clearly defined in an interval between $\pm\pi$, so that a case distinction becomes necessary to determine the phases. In addition, the possible division by zero during implementation should be compensated for, so the phase must be calculated as follows:

$$\Phi_k = \arctan\left(\omega_{M,DFT,k} \frac{|\hat{x}_{1,k}(T)|}{|\hat{x}_{2,k}(T)|}\right) - \omega_{M,DFT,k} T, \quad k = 1, \dots, N_{M,DFT} \quad 5.120$$

With:

$$\begin{aligned} &\text{Case 1:} && \hat{x}_{2,k}(T) > 0, && \Rightarrow \phi_{M,Obs,k} = \Phi_k \\ &\text{Case 2:} && \hat{x}_{1,k}(T) > 0 \wedge \hat{x}_{2,k}(T) = 0, && \Rightarrow \phi_{M,Obs,k} = \pi/2 \\ &\text{Case 3:} && \hat{x}_{1,k}(T) \geq 0 \wedge \hat{x}_{2,k}(T) < 0, && \Rightarrow \phi_{M,Obs,k} = \pi - \Phi_k \\ &\text{Case 4:} && \hat{x}_{1,k}(T) < 0 \wedge \hat{x}_{2,k}(T) < 0, && \Rightarrow \phi_{M,Obs,k} = \pi + \Phi_k \\ &\text{Case 5:} && \hat{x}_{1,k}(T) < 0 \wedge \hat{x}_{2,k}(T) = 0, && \Rightarrow \phi_{M,Obs,k} = 3\pi/2 \end{aligned} \quad 5.121\text{-}5.125$$

The phase of the modes $\phi_{M,obs,k}$, consistent with the modeling of the dip movement, relates to the time $t_0$. As last parameter which can be parametrized with the linear Kalman-Bucy filter the stationary offset of the dip movement must be determined. The same is described by the $2N_{M,DFT}+1$-th state of the observer model and hence is determined according to the following equation.

$$Z_{LA,off,Obs} = \hat{x}_{2N_{M,DFT}+1}(T) \quad 5.126$$

As mentioned already, with the linear observer design it only is possible to achieve an observer-based adaptation of the amplitudes $A_{M,obs}$ of the phases $\omega_{M,obs}$, and the static offset $Z_{LA,obs}$. For the following prediction of the dip movement, the angular frequencies thus must still be adopted from the identification method by means of the discrete Fourier transformation. For a complete, observer-based parametrization of the model of the dip movement, the non-linear approach must be used. By using the presented, non-linear observer, the parameters of the modes are calculated analogous to the linear case.

According to equation 5.102, the states of the extended Kalman filter are defined as set forth below.

$$\underline{x}_{1,k}(t) = A_{M,Obs,k} \sin(\omega_{M,Obs,k} t + \phi_{M,Obs,k}), \quad k = 1, \dots, N_{M,DFT}$$

$$\underline{x}_{2,k}(t)=\omega_{M,Obs,k}A_{M,Obs,k}\cos(\omega_{M,Obs,k}t+\phi_{M,Obs,k}),\ k=1,\ldots,N_{M,DFT}$$

$$\underline{x}_{3,k}(t)=\omega_{M,Obs,k},\ k=1,\ldots,N_{M,DFT}$$

$$\underline{x}_{3N_{M,DFT}+1}(t)=z_{LA,Obs}(t) \qquad 5.127\text{-}5.130$$

The parameters $A_{M,Obs,k}$, $\omega_{M,Obs,k}$, $\phi_{M,Obs,k}$ and $z_{LA,Obs}$ to be used for prediction of the dip movement hence must be calculated in the following order.

$$\omega_{M,Obs,k} = \hat{\underline{x}}_{3,k}(T).\ k = 1, \ldots, N_{M,DFT} \qquad 5.131 - 5.134$$

$$\phi_{M,Obs,k} = \arctan\left(\omega_{M,Obs,k}\frac{\hat{\underline{x}}_{1,k}(T)}{\hat{\underline{x}}_{2,k}(T)}\right) - \omega_{M,Obs,k}T.$$

$$k = 1, \ldots, N_{M,DFT}$$

$$A_{M,Obs,k} = \frac{\hat{\underline{x}}_{1,k}(T)}{\sin(\omega_{M,Obs,k}T + \phi_{M,Obs,k})}.$$

$$k = 1, \ldots, N_{M,DFT}$$

$$z_{LA,Obs} = \hat{\underline{x}}_{3N_{M,DFT}+1}(T)$$

When inverting the tangent, the case distinction indicated in equations 5.121ff. must again be considered.

An embodiment of a control system in which the measurement and prediction methods described above are used for acutating a hoisting gear of a crane will now briefly be described below:

During rough sea conditions, offshore plants lead to strict requirements concerning the safety and efficiency of the crane system concerned. Therefore, a heave compensation system is proposed, which is based on a prediction of the heave movement and an inversion-based control strategy. The control objective consists in having the payload hanging on a rope follow a desired reference path in an earth frame, without being influenced by the heave movement of the ship or watercraft. Therefore, a combination of a control unit, which uncouples the disturbance of the path tracking, and a prediction algorithm is presented and evaluated with simulation and measurement results.

Nowadays, offshore plants, such as underwater extraction systems for oil and gas or wind parks, are increasingly gaining importance. The processing means for the exploitation of oil and gas fields are installed already on the seabed. Therefore, the access possibility for maintenance, repair and replacement is reduced as compared to floating or stationary pumping platforms. In the crane system concerned (see FIG. 1), operating such plants leads to strict requirements as regards safety and efficiency. The main objective consists in ensuring operation during rough sea conditions, in order to minimize downtimes. Furthermore, the safety of the workers on board is essential. Situations may arise, in which the control of the payload gets lost.

Beside the navigation/positioning problem, the movements of the ship/watercraft caused by the waves lead to a critical tensile stress of the rope. The tensile stress should not lie below zero, in order to avoid situations with a slack rope. The peak value should not exceed a safety limit value. Therefore, heave compensation systems are utilized, in order to improve the operability of offshore plants during rough sea conditions. In addition, the vertical movement of the payload can be reduced significantly, which provides for exactly positioning the load.

The present invention provides a heave compensation system, which is based on the prediction of the movement of the ship/watercraft and on an inversion-based control strategy. In principle, there are two requirements for the compensation systems for offshore cranes. The first one consists in having the load follow a desired reference path, which is generated from the hand lever signals of the operator in an earth frame of reference. In this coordinate system, the load should move at the assigned reference speed uncoupled from the movement of the ship caused by the waves. The second requirement is a modular crane with heave compensation. This means, the crane systems used for offshore plants can be erected on many different kinds of ships or watercrafts. In addition, the estimation and prediction algorithm for the vertical movement of the ship/watercraft must be independent of the kind of ship/watercraft.

Figure 8:
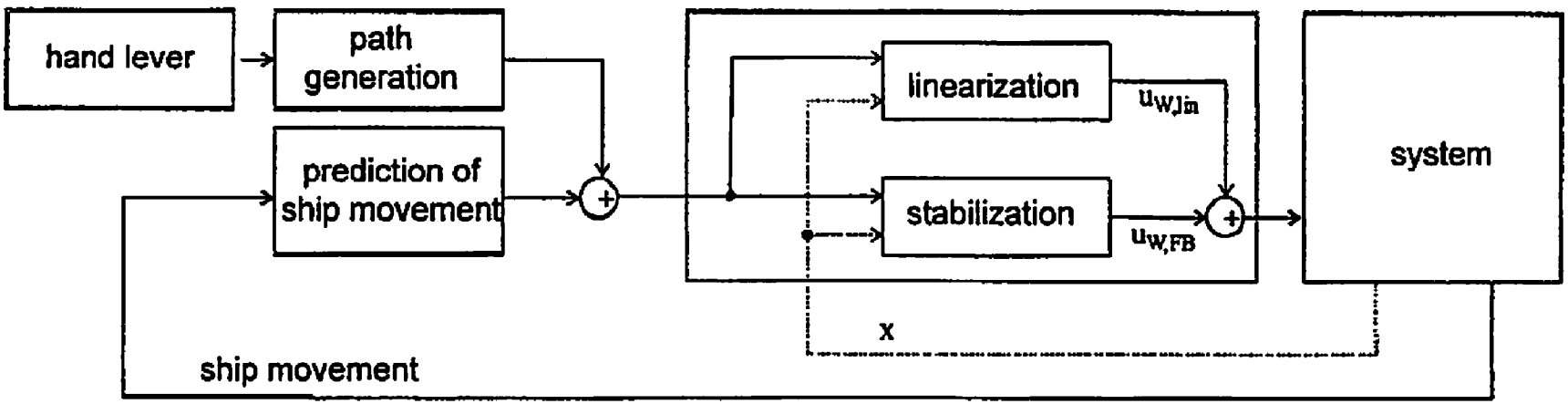
FIG. 8 shows a schematic diagram of an embodiment of a crane control in accordance with the present invention.

For this purpose, the dynamic model of the system, which consists of the hydraulic actuator (winch) and the resilient rope, is derived. Based on this model, a linearizing control law is formulated. For stabilizing the control system, a controller is derived. FIG. 8 shows the general control configuration.

Furthermore, estimation and prediction of the movement of the ship/watercraft are presented. Therefore, a model is formulated, which is based on the prevailing modes of the heave movement. The modes are obtained by a fast Fourier transformation and a peak detection algorithm. Estimation and prediction are effected by a Kalman filter. Simulation and measurement results are displayed.

The Dynamic Model

Figure 9:
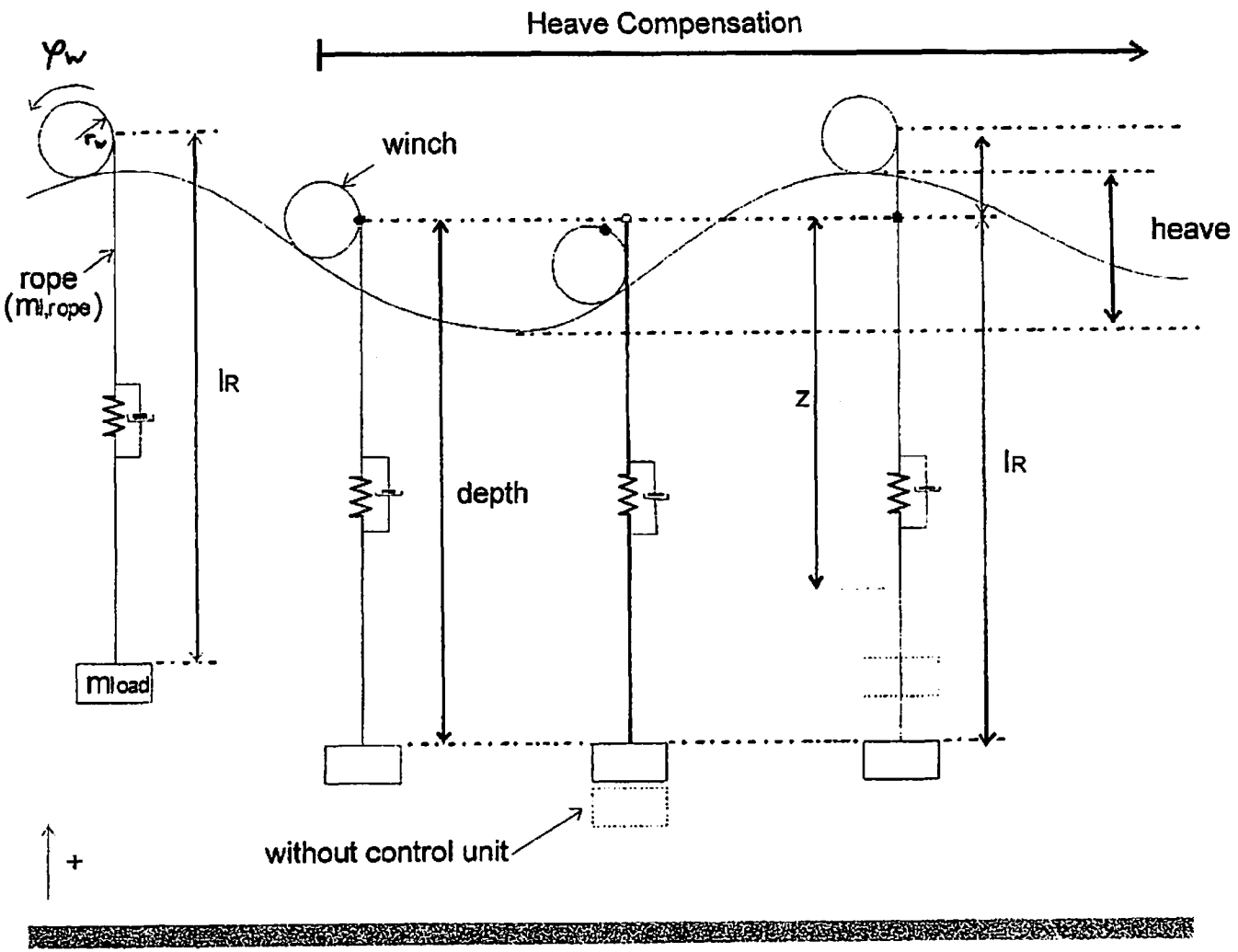
FIG. 9 shows a schematic representation of a model for the dynamics of the system of rope and load.

The heave compensation system disclosed here basically consists of a hydraulically operated winch, a crane-like structure, and the load hanging on a rope. For modeling the system it is assumed that the crane structure is a rigid body. The payload hanging on a rope can be approximated by a spring-mass damper system (see FIG. 9).

For approximating the resilient rope, the equivalent mass $m_{eq}$ and the stiffness of the spring $c_{rope}$ must be calculated. By means of Hooke's law, the deformation $\epsilon(z)$ for a rope with an arbitrary position z can be obtained from:

$$\varepsilon(z) = \frac{\sigma(z)}{E} = \frac{F(z)}{EA_{rope}} = \frac{g}{EA_{rope}}((\text{depth} - z)m_{l,rope} + m_{load}). \qquad (1)$$

$\sigma(z)$ is the tensile stress of the rope, E is Young's modulus, F(z) is the static force acting on the rope at the position z, $A_{rope}$ is the sectional area of the rope, g is the gravitational constant, depth is the distance of the load to the sea level, $m_{l,rope}$ and $m_{load}$ is the mass of the rope per meter and the mass of the payload, respectively.

The elongation of the entire rope $\Delta l_R$ is obtained by means of equation (2).

$$\Delta l_R = \int_0^{depth} \varepsilon(z)dz \qquad (2)$$

$$= \underbrace{g\left(\frac{\text{depth}}{2}m_{l,rope} + m_{load}\right)\frac{\text{depth}}{EA_{rope}}}_{\text{rope suspended load}}$$

$$= \underbrace{\frac{gm_{eq}}{c_{rope}}}_{\text{approximation}}$$

An evaluation of (2) provides $$m_{eq} = \left(\frac{\text{depth}}{2} m_{l,rope} + m_{load}\right) \text{ and } c_{rope} = \frac{\text{depth}}{EA_{rope}}. \tag{3}$$

By means of the method of Newton/Euler, the second-order differential equation for the movement of the payload hanging on a rope is obtained (see (4)). The load oscillations are terminated by winch accelerations $\ddot{\varphi}_W$ and the second derivative of the heave movement $\ddot{w}$.

$$m_{eq}\ddot{l}_R + d_{rope}\dot{l}_R + \frac{EA_{rope}}{\text{depth}}(l_R - \text{depth}) = m_{eq}(r_W\ddot{\varphi}_W + \ddot{w}) \tag{4}$$

The actuator for the heave compensation system is the hydraulically operated winch. The dynamics of this actuator can be approximated with a first-order system.

$$\ddot{\varphi}_W = -\frac{1}{T_W}\dot{\varphi}_W + \frac{2\pi K_{V,W}}{i_W V_{mot,W} T_W} u_W \tag{5}$$

$\ddot{\varphi}_W$ and $\dot{\varphi}_W$ are the angular acceleration and the speed of the winch, $T_W$ is the time constant, $V_{mot,W}$ is the volume of the hydraulic motor, $u_W$ is the input voltage of the servo valve, and $K_{V,W}$ is the proportional constant of the flow rate to $u_W$.

The Control Strategy

To derive a control law, the dynamic model of the system is derived in the following form. The disturbance d is defined as the fourth derivative of the heave movement. Thus, the relative degree of the system is equal to the relative degree of the disturbance and uncoupling the disturbance by Isidori is possible.

$$\dot{\underline{x}} = f(\underline{x}) + g(\underline{x})u_W + p(\underline{x})d$$

$$y = h(\underline{x}) \tag{6}$$

With the states $\underline{x} = [l_R\ \dot{l}_R\ \varphi_W\ \dot{\varphi}_W\ \dot{w}\ \ddot{w}]^T$, equations (4) and (5), and the model expansion, the dynamic equations are obtained as follows:

$$\dot{\underline{x}} = \begin{bmatrix} x_2 \\ -\frac{EA_{rope}}{m_{eq}\text{depth}}(x_1 - \text{depth}) - \frac{d_{rope}}{m_{eq}}x_2 - \frac{r_W}{T_W}x_4 + x_5 \\ x_4 \\ -\frac{1}{T_W}x_4 \\ x_6 \\ 0 \end{bmatrix} + \begin{bmatrix} 0 \\ \frac{2\pi r_W K_{V,W}}{i_W V_{mot,W} T_W} \\ 0 \\ \frac{2\pi K_{V,W}}{i_W V_{mot,W} T_W} \\ 0 \\ 0 \end{bmatrix} u_W + \begin{bmatrix} 0 \\ 0 \\ 0 \\ 0 \\ 0 \\ 1 \end{bmatrix} \dddot{w} \tag{7}$$

$$y = x_1 - r_W x_3 = l_R - r_W\varphi_W$$

For checking the flatness property of the proposed model of the system, the relative degree must be determined.

Relative Degree

The relative degree with respect to the output of the system is defined by the following conditions:

$$L_g L_f^i h(\underline{x}) = 0\ \forall i = 0, \ldots r-2$$

$$L_g L_f^{r-1} h(\underline{x}) \neq 0\ \forall x \in R^n \tag{8}$$

The operator $L_f$ represents the Lie derivative along the vector field f, and $L_g$ along the vector field g. With the output y a relative degree r=4 is obtained. The relative degree of the disturbance is obtained by using (8) with the vector field p instead of g with $r_d$=4. Since the order of the system is n=6, there is a second-order internal dynamics, and y is no flat output. It can be demonstrated that this internal dynamics is the disturbance model. In our case, the internal dynamics consists of a double integrator chain. This means that the internal dynamics is unstable. Thus, solving the internal dynamics by online simulation is impossible. However, for the case of application given here, not only the disturbance $d = \dddot{w}$, but also the states $x_5 = \dddot{w}$ and $x_6 = \ddddot{w}$ can be estimated and predicted by the method explained below. Simulation of the internal dynamics no longer is necessary, and a path-tracking control unit uncoupling the disturbance can be derived.

The Path-Tracking Control Unit

The path-tracking control unit uncoupling the disturbance can be formulated on the basis of the method of input/output linearization.

$$\begin{aligned} u_{W,lin} &= \frac{1}{L_g L_f^{r-1} h(\underline{x})}(-L_f^r h(\underline{x}) - L_p L_f^{r-1} h(\underline{x})\dddot{w} + y_{ref}^{(r)}) \\ &= \frac{m_{eq} i_W V_{mot,W} T_W \text{depth}}{2\pi EA_{rope} r_W K_{V,W}} \cdot \left(\left(-\frac{EA_{rope}}{m_{eq}\text{depth}}\right)^2 (l_R - \text{depth}) + \ldots \ldots \right. \\ &\quad \left. \frac{r_W}{m_{eq} T_W \text{depth}}\dot{\varphi}_W - \frac{EA_{rope}}{m_{eq}\text{depth}}\dddot{w} - \ddddot{w} + \ddddot{y}_{ref}\right) \end{aligned} \tag{9}$$

For stabilizing the resulting controlled system, a control term is added. The term (equation (10)) compensates the error between the reference tracks $\underline{y}_{ref}$ and the derivatives of the output y.

$$u_{W,FB} = \frac{\sum_{i=0}^{r-1} k_i [L_f^i h(\underline{x}) - y_{ref}^{(i)}]}{L_g L_f^{r-1} h^*(\underline{x})} \tag{10}$$

The amplification of the reconversion values $k_i$ is obtained by the pole assignment method. The control structure is illustrated in FIG. 8.

Estimation and Prediction of the Heave Movement

The first part of this section makes a proposal as to how the entire movement of the ship/watercraft can be estimated by measuring with an inertial platform (Initial Measurement Unit (IMU)). As a decisive requirement, any ship-specific information should be used for this estimation. The second part explains a short-term prediction problem. Here, only the heave movement of the cranes is predicted. Complexity is reduced thereby from 6 degrees of freedom to only one, without loosing any required information. As desired above, prediction likewise is completely independent of a ship model.

Measurement of Ship Movement

The ship/watercraft referred to as rigid body has 6 degrees of freedom. With an IMU, the removal of the ship from the stable state can be measured with high precision. These inexpensive independent movement sensors include 3 accelerometers for measuring surf, rocking and heave as well as 3 rotational rate sensors for roll, pitch and yaw. To obtain the desired relative position of the ship, a double integration of the acceleration signals and a single integration of the rotational signals are required. To reduce typical errors such as sensor noise, bias and misalignment of the accelerometers and to ensure a stable integration, the signals can be processed.

When the IMU is not attached to the suspension point of the payload, a simple transformation between the coordinate system of the sensor and the coordinate system of the payload suspension point leads to the desired heave movement.

Prediction of the Movement of the Payload Suspension Point

The fact that the movement of the payload suspension point is not completely chaotic, but depends on the dynamics of the ship and the sea condition, provides for calculating a prediction of its movement. Even a short-term prediction is possible without any knowledge of the properties of the ship.

The main idea of this prediction method is to detect the periodic components of the measured heave movement and use the same for calculating the future heave development. Therefore, the measured heave movement w(t) between two points $t_0$ and T is decomposed into a set of N sinusoidal waves, the so-called modes, and an additional arbitrary term $\upsilon(t)$. This provides a heave movement model, which is described by:

$$w(t) = \left(\sum_{i=1}^{N} A_i \sin(2\pi f_i t + \varphi_i)\right) + \upsilon(t) \quad i = 1, \ldots, N \quad t_0 \le t \le T \tag{11}$$

wherein $A_i$ is the amplitude, $f_i$ is the frequency and $\phi_i$ is the phase of the i-th mode. The objective of prediction is to estimate how many modes are required for a precise prediction of the length $T_{Pred}$, and to adapt the three parameters for each mode.

Figure 10:
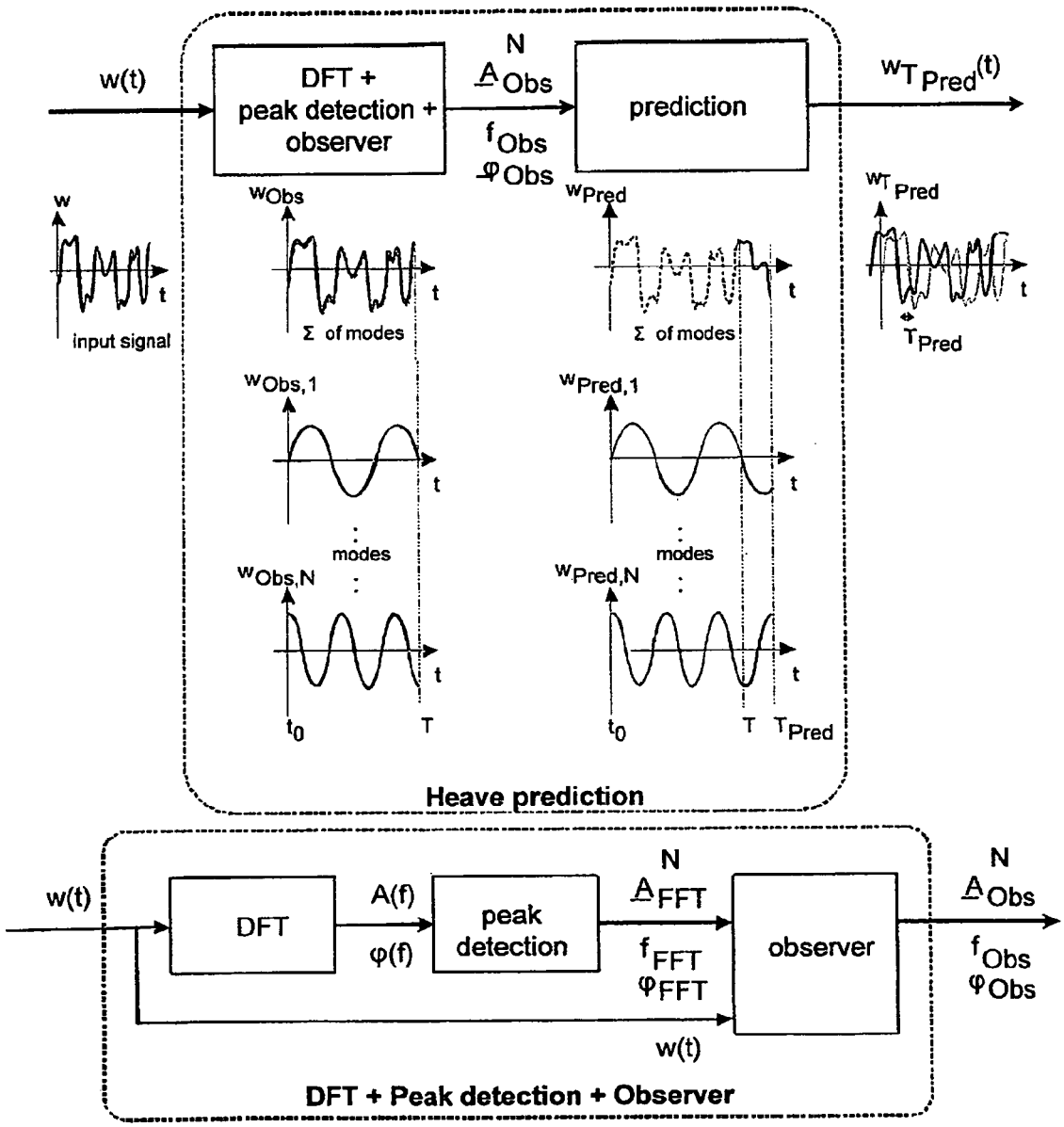
FIG. 10 shows a schematic representation of an embodiment of a prediction method of the heave movement.
Figure 11:
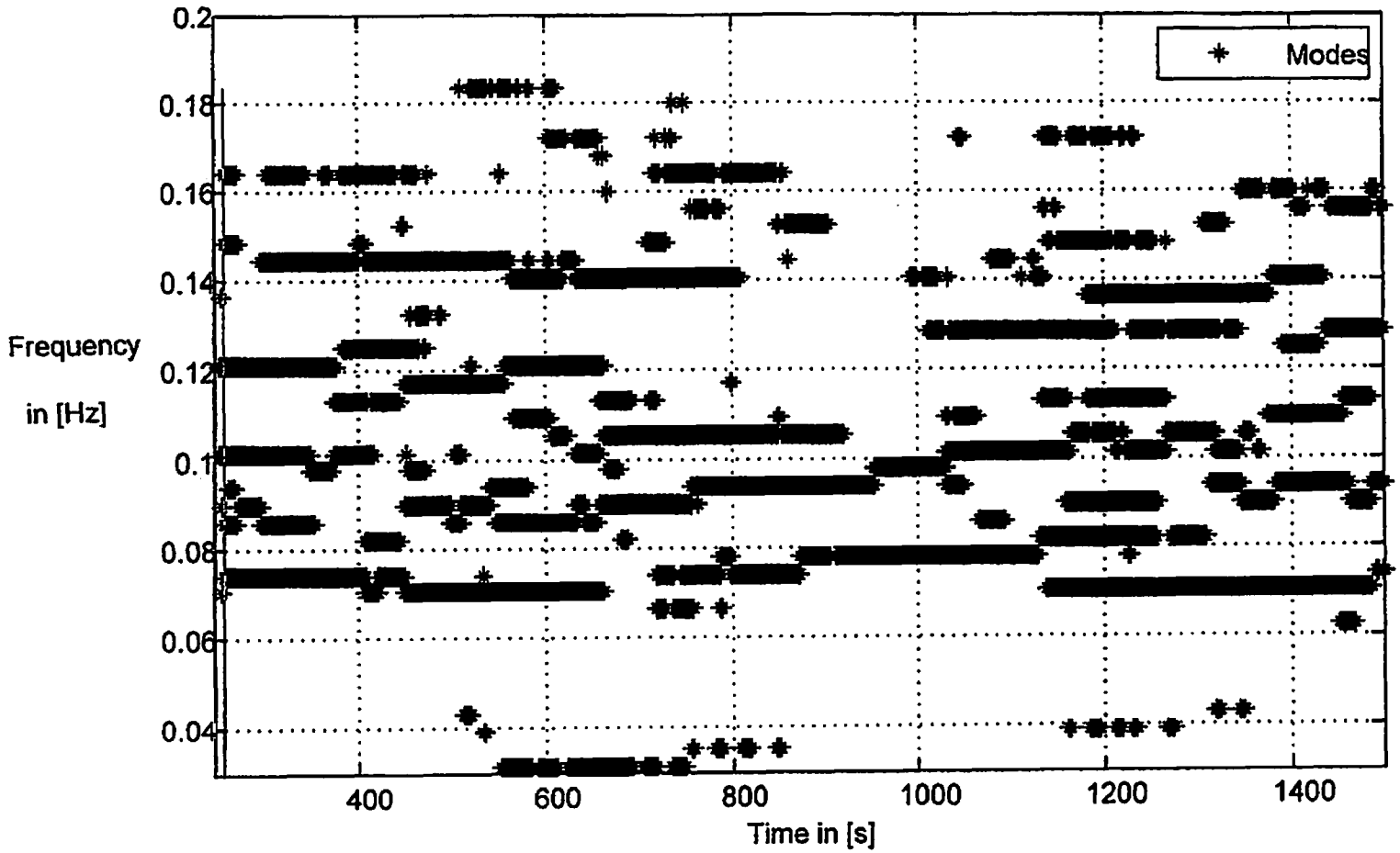
FIG. 11 shows a representation of the change in the prevailing modes of the heave movement over time.

The structure of the prediction method is shown in FIG. 10. First of all, a fast Fourier transformation (FFT) is applied to the measured heave movement w(t). The analyzed length and sampling time of the input signal are chosen such that the maximum frequency of the heave movement can be detected and the desired resolution of the frequencies is achieved. The peaks of the resulting amplitude reaction over the frequency A(f) then are extracted by a peak detector. This leads to a first estimate of the amplitudes and frequencies of the modes, which are stored in the respective parameter vectors $\underline{A}_{FFT}$ and $\underline{f}_{FFT}$. The mode size N is equal to the number of detected peaks. By considering the phase reaction $\phi(f)$, the phases $\underline{\phi}_{FFT}$ of the mode can likewise be defined. With these parameters, which are updated online, the model of the heave movement described in (11) can be parametrized. The evaluation of the really measured heave movement data reveals the necessity of a constantly updated model (see FIG. 11).

Here, the detected peaks of the movement of a ship under rough sea conditions are shown. It can clearly be seen that the modes change during the measurement.

In the next step, an observer adapts the parameter vectors by comparing the measured heave movement w(t) with the modeled heave movement. This is required, because the FFT only detects mean values of a long period, whereas the observer can consider the last changes. With these new parameter vectors, which are designated by $\underline{A}_{obs}$, $\underline{f}_{obs}$ and $\underline{\phi}_{obs}$, the prediction of the heave movement can be performed by again using (11).

Observer

The configuration of the observer depends on a heave movement model, which is described by a set of ordinary differential equations (ODEs). There are two possibilities for converting the model (11) into a set of ODEs. On the one hand, the heave movement can be modeled as a non-linear system, which enables the observer to estimate all parameters necessary for predicting the heave. Due to the requirement to obtain an online prediction, this method can, however, not be used on modern computers. Instead, a linear model can be used. Here, merely the frequencies of the mode are not adapted again. However, the same are in any case estimated by the FFT with high precision. When choosing the linear method, a Kalman filter can be used. This provides an observer equation as shown below.

$$\dot{\hat{\underline{x}}} = A\hat{\underline{x}} + L(w - \hat{w}) \quad \hat{\underline{x}}(t_0) = \underline{x}_0$$

$$\hat{w} = C\hat{\underline{x}} \quad t_0 \le t \le T \tag{12}$$

The system matrices A and C are obtained from the heave movement model described below, whereas the prediction results also depend on properly defining the correction matrix.

For converting the heave model described in (11), which is suitable for an observer, an individual mode can be defined by the ODE:

$$\dot{\underline{x}} = A_i \underline{x} = \begin{pmatrix} 0 & 1 \\ -(2\pi f_i)^2 & 0 \end{pmatrix} \underline{x} \quad \underline{x}(t_0) = \underline{x}_{0,i} = \begin{pmatrix} A_i \sin(\varphi_i) \\ 2\pi A_i f_i \cos(\varphi_i) \end{pmatrix} \tag{13}$$

$$w_i = C_i \underline{x} = (1 \quad 0)\underline{x} \qquad i = 1, \ldots, N.$$

Applying the parameter vectors obtained by FFT, adding up all modes and introducing an offset state, which does not represent the periodic term u(t), leads to the observer heave model $$\dot{\underline{x}} = A\underline{x} = \begin{bmatrix} A_1 & 0 & \ldots & \ldots & 0 \\ 0 & A_2 & \ddots & & \vdots \\ \vdots & \ddots & \ddots & \ddots & \vdots \\ \vdots & & \ddots & A_N & 0 \\ 0 & \ldots & \ldots & 0 & 0 \end{bmatrix} \underline{x} \quad \underline{x}(t_0) = \underline{x}_0 = \begin{bmatrix} \underline{x}_{0,1} \\ \underline{x}_{0,2} \\ \vdots \\ \underline{x}_{0,N} \\ 0 \end{bmatrix} \tag{14}$$

$$w(t) = C\underline{x} = [\, C_1 \quad C_2 \quad \ldots \quad C_N \quad 1 \,]\underline{x}.$$

Choosing the L matrix elements can be achieved by means of the filter design of Kalman and Bucy. This requires solving the Riccati equation (solution is P) and calculating the amplification matrix L, as is described in (15).

$$PC^T R^{-1} CP - AP - PA^T - Q = 0$$

$$L = PC^T R^{-1} \tag{15}$$

Here, the Q used as design parameter is chosen as diagonal matrix, where fast modes are punished more than slow ones, whereas R uniformly influences all modes.

The parameters adapted by the observer can be extracted from their states. Based on the equations of an individual mode $$\hat{x}_{1,i}(t)=A_{Obs,i}\sin(2\pi f_{FFT,i}t+\phi_{Obs,i})$$

$$\hat{x}_{2,i}(t)=2\pi A_{Obs,}f_{FFT,i}\cos(2\pi f_{FFT,i}t+\phi_{Obs,i}) \quad (16)$$

the new parameters can be calculated by:

$$f_{Obs,i} = f_{FFT,i} \quad (17)$$

$$\varphi_{Obs,i} = \arctan\left(\frac{\hat{x}_{1,i}(T)}{\hat{x}_{2,i}(T)}\right) - 2\pi f_{FFT,i}T$$

$$A_{Obs,i} = \frac{\hat{x}_{1,i}(T)}{\sin(2\pi f_{FFT,i}T + \varphi_{Obs,i})} \quad i = 1, \ldots, N.$$

Prediction

The last part of the prediction method is the calculation of the prediction itself. Therefore, (11) can be used by employing the parameter vectors adapted by the observer, which provides:

$$w_{Pred}(t) = \left(\sum_{i=1}^{N} A_{Obs,i}\sin(2\pi f_{Obs,i}t + \varphi_{Obs,i})\right) + \upsilon(t) \quad (18)$$

$$i = 1, \ldots, N, T \le t \le T_{Pred}$$

The progression of the non-periodic term $\upsilon(t)$ cannot be predicted. Since it is equal to the offset state of the observer, it should be defined as constant with $$\upsilon(t)=\text{const.}=\hat{x}_{2N+1}(T)T\leqq t\leqq T_{Pred}. \quad (19).$$

Figure 12:
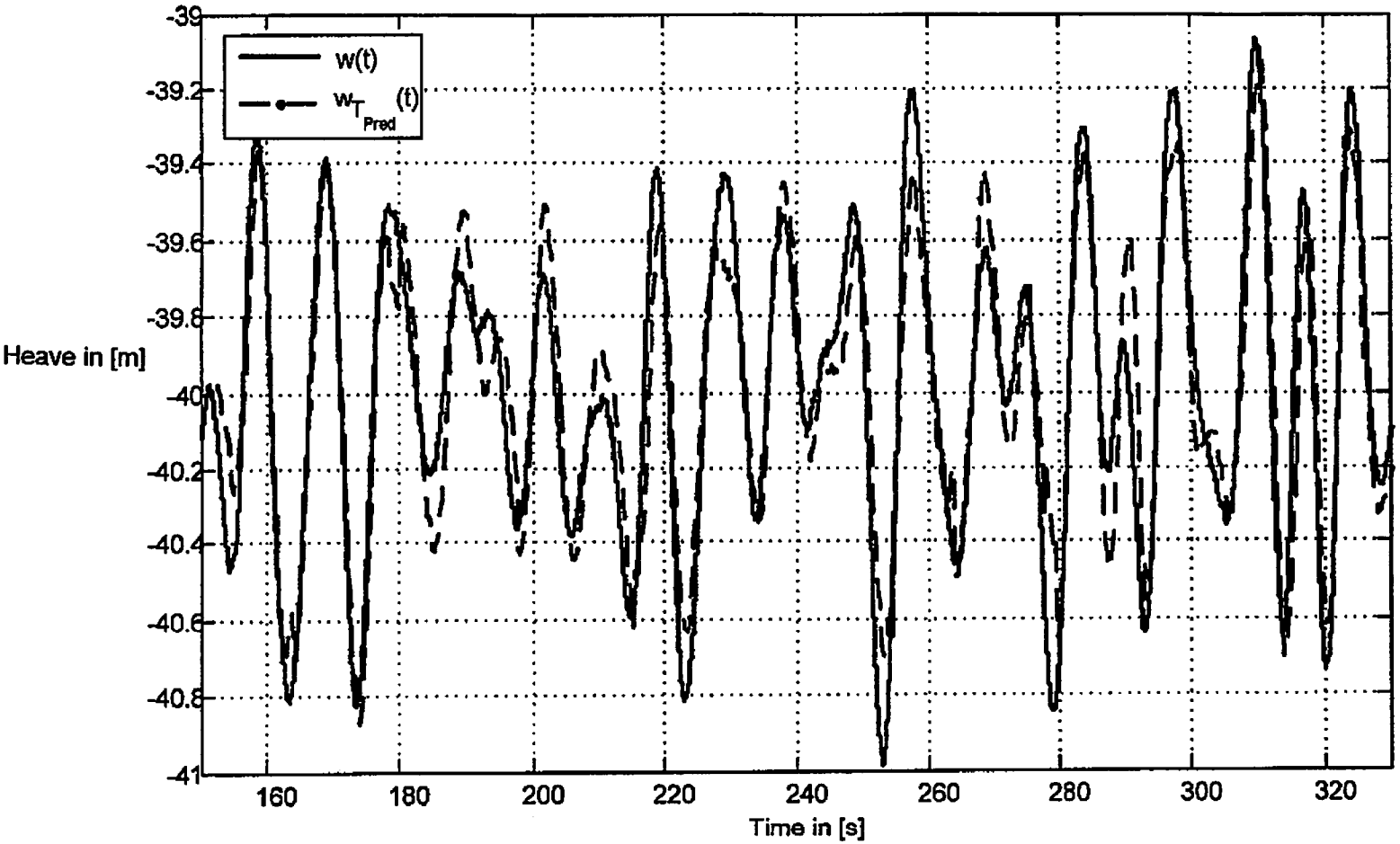
FIG. 12 shows a representation of a predicted and an actual heave movement.

To provide a brief impression of the performance of sea-wave prediction, simulation results are set forth below. Therefore, real IMU signals of a ship under rough sea conditions were used, in order to reproduce the heave movement. FIG. 12 shows the time course of the predicted and measured heave movement. The prediction interval $T_{Pred}$ chosen was 1 second. For better illustration, the predicted heave movement then was set back in time. Thus, an error-free predicted signal would correspond with the measured signal.

Simulation and Measurement Results

Figure 13:
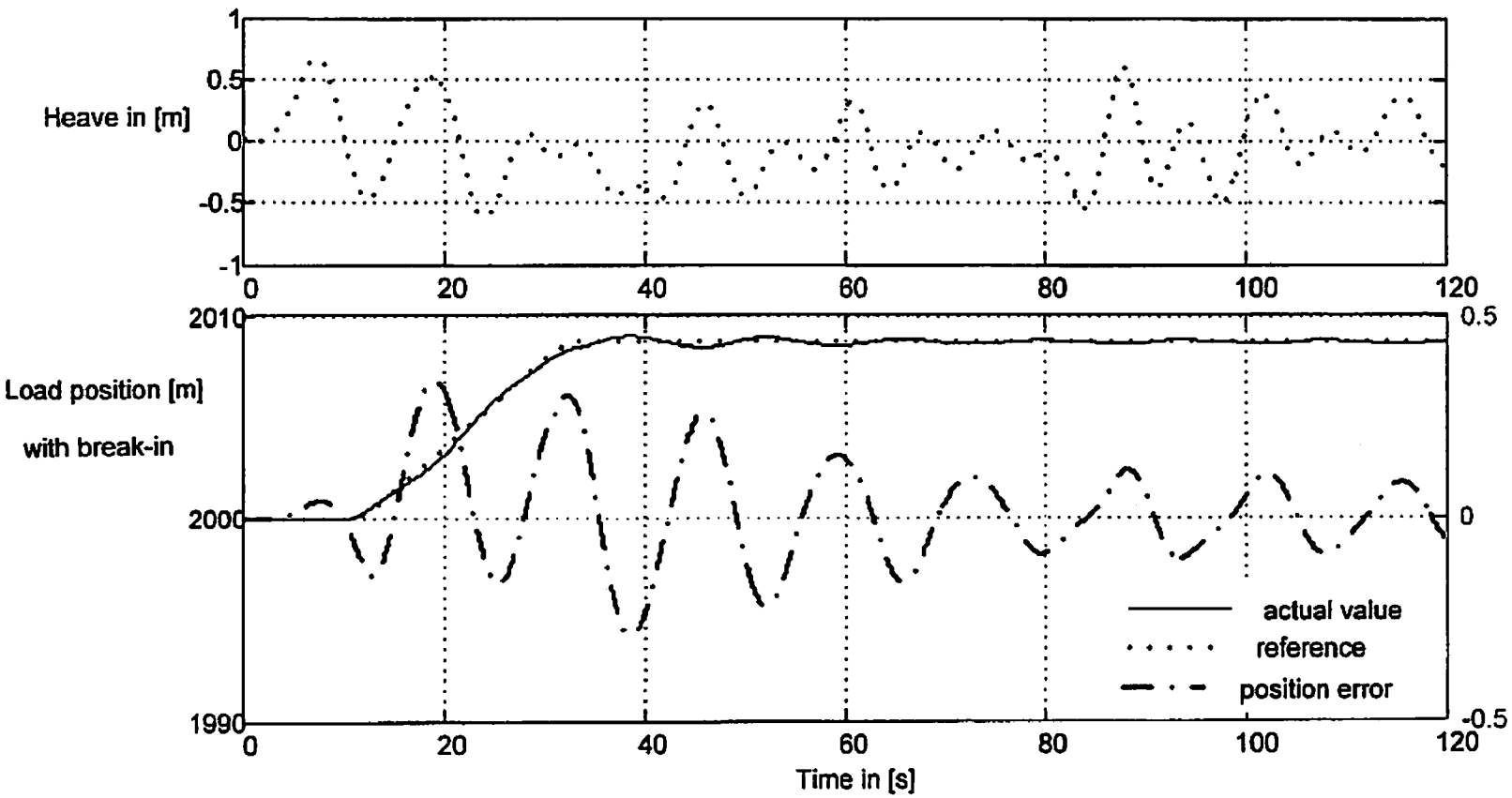
FIG. 13 shows a graphical representation of the load movement with a pure pilot control without feedback and without prediction.

FIG. 13 shows the simulated compensation behavior of the heave compensation system. The reference path is generated by a hand lever signal, and the crane is exposed to a heave movement. For this simulation, there was merely used a linearizing control unit without stabilization. With this structure, the excitation of the suspension point movement of the payload, which is shown in the first plot in FIG. 14, can be reduced by a factor of 5. The reason why these oscillations cannot be suppressed completely is the fact that the system of pump and motor has been simulated with a dead time which is not considered in the design of the control unit.

Figure 14:
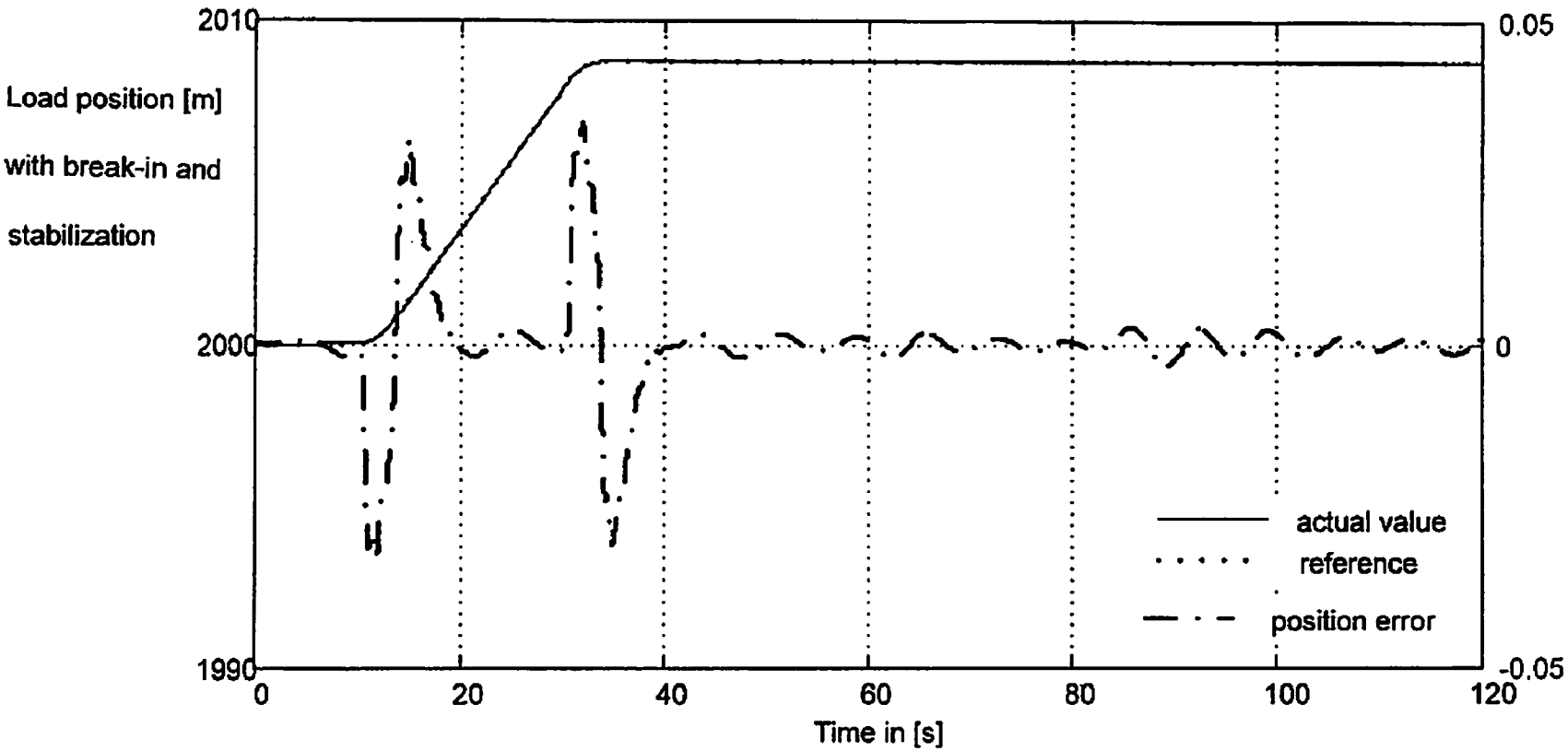
FIG. 14 shows a graphical representation of the load movement with a closed control circuit, but without prediction.

Using the observer and closing the circuit of the control system enormously improves the compensation behavior. As shown in FIG. 14, the simulated shift in position never is greater than ±3 cm.

Figure 15:
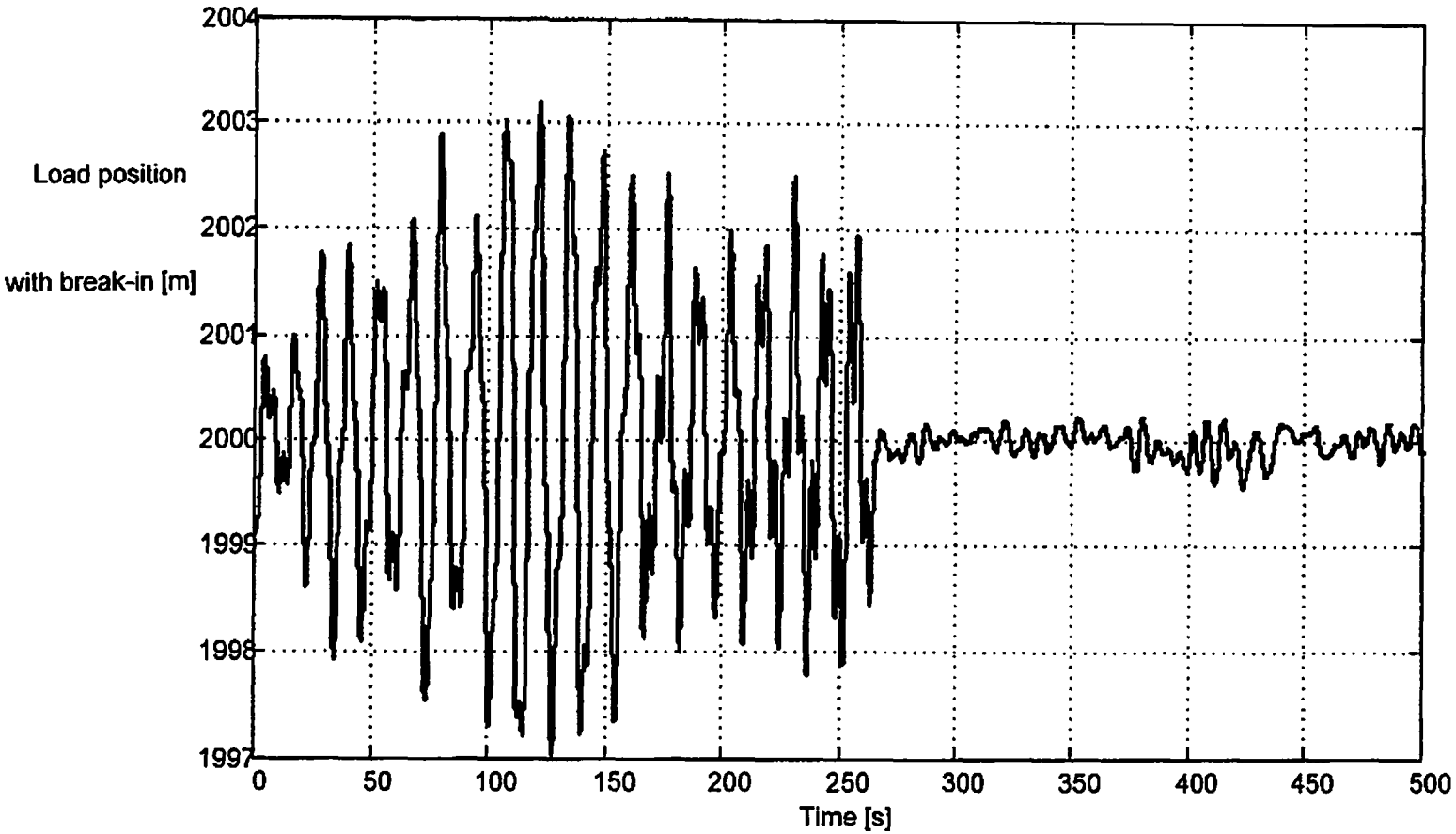
FIG. 15 shows a graphical representation of the load movement by using the control method in accordance with the present invention.

In the first two simulations, the heave prediction was shut off. FIG. 15 shows the compensation behavior of the payload position with open circuit with a heave prediction in the range of the dead time of the actuator (0.2 seconds). Quite obviously, good heave compensation results are achieved, as soon as the linearizing control unit is activated, which is effected at the time 250 s. When comparing the compensation with and without heave prediction, a clear improvement can be noted.

To improve the simulation results, measurements with an experimental set-up were performed.

The invention claimed is:

1. A crane control with active heave compensation for a crane arranged on a floating body, which includes a hoisting gear for lifting a load hanging on a rope, comprising a measuring device, which determines a current heave movement from sensor data, a prediction device, which predicts a future vertical movement of the load suspension point with reference to the current heave movement determined and a model of the heave movement, and a path control of the load, which by actuating the hoisting gear of the crane on the basis of the predicted movement of the load suspension point at least partly compensates the vertical movement of the load caused by the sea waves.

2. The crane control according to claim 1, wherein the model of the heave movement used in the prediction device is independent of the dynamics of the floating body.

3. The crane control according to claim 1, wherein the prediction device determines the prevailing modes of the heave movement from the data of the measuring device, via a frequency analysis, and creates a heave model with reference to the prevailing modes determined.

4. The crane control according to claim 3, wherein the prediction device continuously parametrizes the model with reference to the data of the measuring device based on an observer, wherein in particular amplitude and phase of the modes are parametrized.

5. The crane control according to claim 4, wherein the model is updated in the case of a change in the prevailing modes of the sea waves.

6. The crane control according to claim 3, wherein the model is updated in the case of a change in the prevailing modes of the sea waves.

7. The crane control according to claim 1, wherein the path control includes a pilot control which is stabilized on the basis of sensor data.

8. The crane control according to claim 1, wherein the path control is based on a model of crane, rope and load, which considers a change in the rope length due to an elongation of the rope.

9. The crane control according to claim 8, wherein a force sensor is provided for measuring the force acting in the rope and/or on the hoisting gear, whose measurement data are included in the path control and by which in particular the rope length is determined.

10. The crane control according to claim 1, wherein the path control is based on a model of crane, rope and load, which considers the dynamics of the hoisting gear and/or of the rope and in particular is based on a physical model of the dynamics of the system of hoisting gear, rope and/or load.

11. The crane control according to claim 1, wherein the measuring device comprises gyroscopes, acceleration sensors and/or GPS elements, from whose measurement data the current movement of the load suspension point is determined.

12. The crane control according to claim 1, wherein the sensors of the measuring device are arranged on the crane, in particular on the crane foundation, and the measuring device advantageously determines the movement of the load suspension point with reference to a model of the crane and the relative movement of load suspension point and measurement point.

13. The crane control according to claim 1, wherein the measuring device only determines the movement of the load suspension point in the vertical.

14. A crane with a crane control according to claim 1.

15. A method for controlling a crane arranged on a floating body, which includes a hoisting gear for lifting a load hanging on a rope, with the following steps:

determining the current heave movement from sensor data, predicting a future vertical movement of the load suspension point with reference to the current heave movement determined and a model of the heave movement, and at least partly compensating the vertical movement of the load caused by the sea waves by actuating the hoisting gear of the crane on the basis of the predicted movement of the load suspension point.

16. The method according to claim 15 comprising the additional step of using a crane control comprising a measuring device, which determines a current heave movement from sensor data, a prediction device, which predicts a future movement of the load suspension point with reference to the current heave movement determined and a model of the heave movement, and a path control of the load, which by actuating the hoisting gear of the crane on the basis of the predicted movement of the load suspension point at least partly compensates the movement of the load caused by the sea waves.

17. The crane control according to claim 16, wherein the prediction device determines the prevailing modes of the heave movement from the data of the measuring device based on the frequency analysis, and creates the heave model with reference to the prevailing modes determined.

18. The crane control according to claim 17, wherein the prediction device continuously parametrizes the model with reference to the data of the measuring device based on an observer, wherein in particular amplitude and phase of the modes are parametrized.

19. The crane control according to claim 18, wherein the model is updated in the case of a change in the prevailing modes of the sea waves.

20. The crane control according to claim 17, wherein the model is updated in the case of a change in the prevailing modes of the sea waves.

* * * * *